US005440894A

United States Patent [19]

Schaeffer et al.

[11] Patent Number: 5,440,894

[45] Date of Patent: Aug. 15, 1995

[54] STRATEGIC MODULAR COMMERCIAL REFRIGERATION

[75] Inventors: Wayne G. Schaeffer, Ballwin; William C. Wehmeier, St. Charles; Terry J. Broccard, St. Louis; John A. Behr, Defiance, all of Mo.

[73] Assignee: Hussmann Corporation, Bridgeton, Mo.

[21] Appl. No.: 57,617

[22] Filed: May 5, 1993

[51] Int. Cl.[6] ..... F25D 23/12

[52] U.S. Cl. ..... 62/203; 62/259.1; 62/452; 62/510

[58] Field of Search ..... 62/510, 115, 452, 175, 62/259.1; 236/1 EA

[56] References Cited

U.S. PATENT DOCUMENTS

| | | | |
|---|---|---|---|
| 2,267,607 | 12/1941 | Harvey | 62/506 |
| 2,727,364 | 12/1955 | Perez | 62/510 U X |
| 2,954,877 | 10/1960 | Sweynor | 62/510 U X |
| 3,205,674 | 9/1965 | Arnold et al. | 62/259.1 |
| 3,210,957 | 10/1965 | Rutishauser et al. | 62/255 |
| 3,242,686 | 3/1966 | Bowman et al. | 62/510 X |
| 3,520,146 | 7/1970 | Arnold et al. | 62/115 |
| 3,590,595 | 7/1971 | Briggs | 62/197 |
| 3,653,221 | 4/1972 | Angus | 62/59 |
| 3,675,441 | 7/1972 | Perez | 62/434 X |
| 3,763,658 | 10/1973 | Gaumer, Jr. et al. | 62/335 X |
| 3,995,443 | 12/1976 | Iversen | 62/305 |
| 4,000,626 | 1/1977 | Webber | 62/335 X |
| 4,170,117 | 10/1979 | Faxon | 62/305 X |
| 4,266,406 | 5/1981 | Ellis | 62/305 X |
| 4,280,335 | 7/1981 | Perez et al. | 62/332 |
| 4,384,462 | 5/1983 | Overman et al. | 236/1 EA |
| 4,454,728 | 6/1984 | Hanada et al. | 62/335 X |
| 4,513,574 | 4/1985 | Humphreys et al. | 62/59 |
| 4,535,602 | 8/1985 | Alsenz et al. | 62/175 |
| 4,535,603 | 8/1985 | Willitts et al. | 62/238.6 X |
| 4,628,700 | 12/1986 | Alsenz | 62/152 |
| 4,656,836 | 4/1987 | Gilbertson | 62/185 |
| 4,732,007 | 3/1988 | Dolan et al. | 62/238.6 X |
| 4,751,823 | 6/1988 | Hans | 62/201 |
| 4,802,338 | 2/1989 | Oswalt et al. | 62/98 |
| 4,819,444 | 4/1989 | Meckler | 62/238.6 |
| 4,827,735 | 5/1989 | Foley | 62/434 X |
| 4,850,201 | 7/1989 | Oswalt et al. | 62/185 |
| 5,038,574 | 8/1991 | Osborne | 62/101 |
| 5,042,262 | 8/1991 | Gyger et al. | 62/434 |
| 5,044,172 | 9/1991 | Inoue et al. | 62/335 |
| 5,065,591 | 11/1991 | Shaw | 62/175 |
| 5,072,596 | 12/1991 | Gilbertson et al. | 62/434 X |
| 5,076,067 | 12/1991 | Prenger et al. | 62/126 X |
| 5,211,031 | 5/1993 | Murayama et al. | 62/498 |
| 5,335,508 | 8/1994 | Tippmann | 62/129 |

FOREIGN PATENT DOCUMENTS

| | | | |
|---|---|---|---|
| 0217167 | 8/1989 | Japan | 62/510 |

OTHER PUBLICATIONS

Gordon Duffy and Ed Bas; Article Entitled "Two-Stage System Uses R-22"; Air Conditioning, Heating & Refrigeration News; Aug. 17, 1994; pp. 30 and 31.

*Primary Examiner*—William E. Wayner
*Attorney, Agent, or Firm*—Richard G. Heywood

[57] ABSTRACT

A commercial refrigeration network including refrigeration system units constructed and arranged for placement in strategic proximity to corresponding product cooling zones within the shopping arena of a food store, each refrigeration unit having a condensing unit rack configured to accommodate the maximum refrigeration loads of its associated zone with an optimum floor space footprint in the shopping arena, and the condensing unit rack including a plurality of multiplexed compressors, condenser and associated high side and low side refrigerant delivery and suction conduits operatively connected to evaporators for cooling the corresponding zone, and the network also including another cooling source remote from said modular refrigeration units and constructed and arranged for circulating a fluid coolant in heat exchange relationship with the condenser to obtain optimum condensing and efficiency of said evaporators in cooling the corresponding zone.

107 Claims, 11 Drawing Sheets

STRATEGIC MODULAR COMMERCIAL REFRIGERATION

BACKGROUND OF THE INVENTION

FIELD OF THE INVENTION

This invention relates generally to the commercial refrigeration art, and more particularly to modular refrigeration system units strategically located in close proximity to product zones to be cooled and networked with an external condenser coolant system.

Although great advances have been made over the last 50 years in the design, convenience, operating efficiency and other aspects of refrigerated merchandisers and various commercial systems therefor, the conventional "remote machine room" approach to the location of system compressors has not changed. Of course, self-contained commercial cases, which like domestic refrigerators have their own condensing have always had a place in food merchandising, particularly in small convenience stores in which a few merchandising units can operate at relatively low noise levels. However, with the growth of retail food merchandising into large supermarkets, the expansion of commercial refrigeration requirements has been staggering. For example, a 50,000 square foot supermarket may have refrigerated display fixtures and other coolers and preparation rooms requiring an aggregate refrigeration capacity in excess of 80 tons (1,000,000 BTU/hr.) which may include over 20 tons of low temperature refrigeration at evaporator temperatures in the range of −35° F. to −5° F. and over 60 tons of normal temperature refrigeration at evaporator temperatures in the range of 15° F. to 40° F. Such presently existing commercial refrigeration systems have a multitude of evaporators (e.g., 100) for the various refrigerated product merchandisers located throughout the shopping area of the supermarket; and these evaporators are usually serviced by multiplexed low temperature and normal temperature compressor systems, each compressor typically being of the reciprocating type and located in the back room of the supermarket. It is not feasible to provide self-contained refrigerated product merchandisers (each with its own compressor) for stand-alone operation in a supermarket setting for numerous reasons, including cost and energy efficiency. Moreover, a single compressor in a self-contained case has no back-up in case of failure, no control over its rejected heat into the shopping arena, and a large number of reciprocating compressors would generate so much noise as to be totally unacceptable.

The most recent conventional practice is to put the massive refrigeration requirements of a supermarket into at least two multiplexed back room systems; one for the low temperature refrigeration of frozen foods and ice cream at product temperatures in the range of −20° F. to 0° F.; and another for the normal temperature refrigeration of fresh foods including meat, dairy and produce at product temperatures in the range of 28° F. to 50° F. Each such system is a closed system having a single condenser/receiver and liquid header with parallel circuits to the respective merchandiser or cooler evaporators and with the various complex valving requirements to balance suction pressures (EPR valves) and to accommodate selective evaporator isolation for hot gas or other types of defrosting. In any event, the multiplexed compressors of such systems are installed in remote or back machine rooms and typically connect to roof top air-cooled condensers, which in turn connect back to the machine room to a receiver and thence to the liquid header and various high side valving and liquid line circuit outlets. Again, the suction side of the various circuits are connected to a machine room suction header for each multiplexed system, and the various suction control EPR valves and hot gas distribution valves are located in this remote machine back room.

To connect the back room compressors and the store merchandiser evaporators for delivery and return of refrigerant in a large supermarket of the 50,000 square foot example, substantial lengths of refrigerant conduit piping must be employed, e.g., on the order of 18,000 feet of conduit may be required in which a large volume of relatively expensive refrigerant (e.g., 1800 pounds of Refrigerant 502 at about $8 per pound) is required just to fill these conduits for connection of the remote refrigeration systems. Should line breaks or leakage occur as from fissures in the conduits or joints (frequently caused by expansion and contraction of the conduits as during a defrost cycle), then substantial quantities of expensive refrigerant may be lost and the entire system jeopardized. The greater the length of the conduit, the more expansion will occur, creating a higher risk of breakage. It should also be recognized that, in response to environmental concerns over depletion of the ozone layer due to the release of various CFC products including different refrigerants, such as R-502 that have been commonly in use in the commercial supermarket refrigeration industry for many years, the government has imposed increasingly stricter limitations on such refrigerant usage. The result is that this industry, and others, are developing new non-CFC types of refrigerants as well as seeking other system arrangements and controls for minimizing environmental endangerment. However, such new refrigerants today are even more expensive than heretofore used in large volumes in typical prior art commercial system installations, thereby raising basic installation costs and creating higher loss risks in such conventional back room commercial systems. For instance, Refrigerant HP62, which is an HFC chemical, costs over $13 per pound.

So-called "cascade" refrigeration systems are well established refrigeration techniques where relatively low temperatures are to be achieved in the controlled zone or environment, particularly in industrial refrigeration and some cryogenic applications. In such cascade arrangements, a second stage is used to cool a first stage condenser. Briggs U.S. Pat. No. 3,590,595 discloses a cascade system for use with a remote primary system having a "back room" compressor/condenser arrangement with long liquid line conduits to the controlled refrigerated zone; and provides bypass means to obviate heat pickup and refrigerant vaporization due to intermittent evaporator cooling operations or other conditions in which the continuous liquid line flow to the evaporator is interrupted.

Perez U.S. Pat. No. 4,280,335 discloses an icebank refrigerating and cooling system utilizing off-peak ice storage as a direct primary refrigeration source for various supermarket normal temperature cooling purposes, such as air conditioning, produce, dairy and beverage cooling. Perez also suggests that the ice storage system can be employed as a cascade-type heat exchanger for another compressor/condenser system, but Perez discloses a only water loop from the return (heated) water conduit for this purpose. However, although thermal (ice) storage systems are prevalent in the refrigeration art, such technology is not considered practical as an alternative coolant source for commercial supermarket applications of the present invention for several reasons, among which is that the massive heat of rejection loads from the low and normal temperature merchandisers is carried by the return coolant circuit.

SUMMARY OF THE INVENTION

This invention is embodied in a modular commercial refrigeration network having plural units constructed and arranged for placement in strategic compatible proximity to corresponding product cooling zones within the shopping arena of a food store, each refrigeration unit including a condensing unit rack configured to accommodate the refrigeration loads of the corresponding zone with an optimum floor space footprint in the shopping arena, and each condensing unit rack including a closed refrigeration circuit having a plurality of multiplexed compressor means, condenser means and associated high side and low side refrigerant delivery and suction means operatively connected to evaporator means for cooling the corresponding zone, and another cooling source remote from the modular refrigeration units but having a heat exchange relationship with each condenser means for providing optimum condensing and efficiency of the evaporator means in cooling the corresponding zone.

A principal object of this invention is to provide a dedicated modular commercial refrigeration unit disposed in close proximity to a discrete product load serviced by the unit, such as a group of refrigerated display merchandisers operating at approximately the same temperature.

Another object of this invention is to provide a plurality of modular refrigeration system units for dedicated product display and storage zones within a supermarket, to substantially reduce the amount of refrigerant and refrigerant piping required for the system as well as parasitic losses such as liquid line heat pickup and pressure drop, and to network the modular units with an efficient condenser heat exchange system.

Another object of this invention is to provide a modular refrigeration unit that can be integrated with the display merchandisers into shopping arena arrangements.

Another feature of this invention is to provide a cascade-type coolant system for a plurality of separate modular refrigeration system units to selectively discharge the heat of rejection from the refrigeration units to a location outside the supermarket or to recover such heat for in-store supermarket heating.

It is another object of this invention to lower construction costs by eliminating the need for a remote machine room for system compressors and the long piping runs to the merchandisers, and to simplify system installation and display case hookup.

Another object is to provide an efficient, economical and easily serviced commercial refrigeration system.

A further objective of the invention is to provide modular refrigeration system units of variable configuration to accommodate optimum placement for efficient operation and service.

A still further objective is to provide modular refrigeration system units constructed and arranged with multifunctional enclosures for installation in a supermarket shopping arena in proximity to dedicated refrigeration merchandiser zones with a minimum floor space footprint, and offering noise abatement, merchandising decor and ancillary product display features.

Another object is to provide modular system units minimizing refrigerant requirements, providing lower noise and vibration characteristics and energy efficient multiple compressor operation with backup capacity.

Another object is to provide modular refrigeration system units with predetermined piping configurations, standardized component and layout to reduce brazed joints and installation costs.

These and other objects and advantages will become more apparent hereinafter.

DESCRIPTION OF THE DRAWINGS

For illustration and disclosure purposes the invention is embodied in the parts and the combinations and arrangements of parts hereinafter described. In the accompanying drawings forming a part of the specification and wherein like numerals refer to like parts wherever they occur.

DESCRIPTION OF THE PREFERRED EMBODIMENTS

For disclosure purposes, the term "high side" is used herein in a conventional refrigeration sense to mean the portion of a system from the compressor discharge to the evaporator expansion valves, and the term "low side" means the portion of the system from the expansion valves to the compressor suction. Also, "low temperature" as used herein shall have reference to evaporator temperatures in the range of −35° F. to −5° F. or the associated frozen food and ice cream product temperatures in the range of −20° F. to 0° F.; and "normal temperature" means evaporator temperatures in the range of about 15° F. to 40° F. or the associated non-frozen or fresh refrigerated food temperatures in the range of 25° F. to 50° F. "Medium temperature" is also used interchangeably for "normal temperature" in the refrigeration industry.

Figure 1:
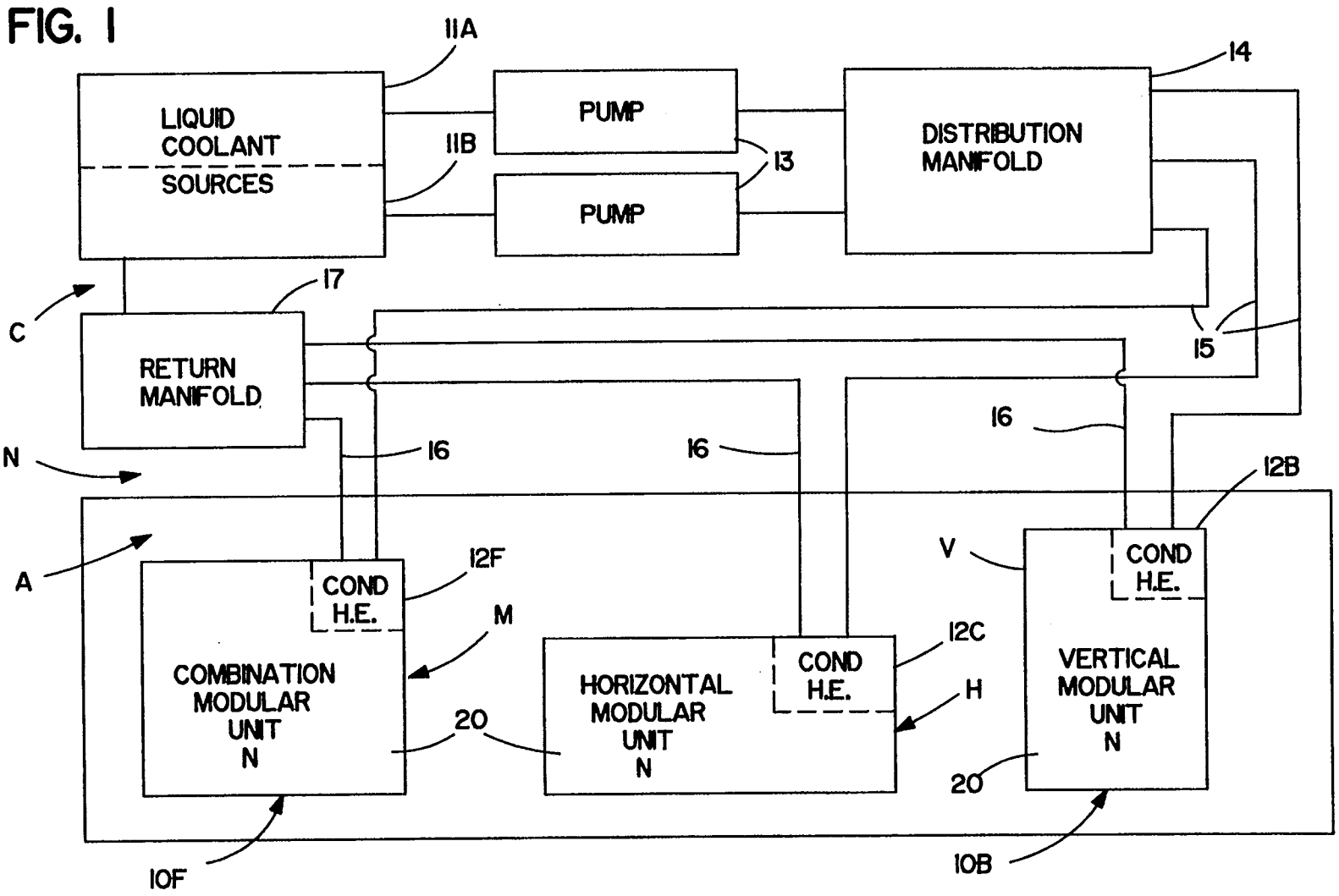
FIG. 1 is a block diagram illustrating a modular commercial refrigeration network embodying the invention as utilized in a supermarket.

Referring now to FIG. 1 of the drawings, the invention is illustrated diagrammatically in the form of a commercial refrigeration network N having a plurality of modular refrigeration system units 10 constructed and arranged for placement in strategic proximity to corresponding product cooling zones within a commercial foodstore or supermarket S. The location of the refrigeration units 10 may be inside or outside the customer shopping arena of the supermarket, which is designated generally by the reference numeral A. As will be described in more detail hereinafter, each modular refrigeration unit 10 is sized to efficiently maintain its associated discrete cooled zone at optimum refrigeration temperatures, and each of these zones comprises one or more of the supermarket coolers, freezers, preparation rooms or display merchandisers—usually an area department or lineup of merchandising fixtures operating at substantially the same temperature.

The invention further comprises a coolant circulating system C constructed and arranged to circulate a cooling fluid or coolant from a remote source (11) to the respective unit condenser/heat exchangers marked "COND. H.E." in FIG. 1. Thus, the coolant system C derives a cooling liquid, such as water or glycol, from one or more sources 11A and 11B and circulates it by at least one pump 13 through a distribution arrangement that may include a distribution manifold 14 and branch coolant delivery lines or conduits 15 to the condenser/-heat exchanger H.E. of each modular unit 10. It will be seen that at least two alternate cooling sources 11A and 11B and two circulating pumps 13 are illustrated as a preferred arrangement to assure a back-up condenser cooling system. Branch return conduits 16 and a return manifold 17 carry away the coolant fluid with the exchanged heat of rejection from the respective unit condensers. The coolant source 11A, 11B may be a single fluid cooling apparatus, such as a closed or open loop roof top cooling tower 11A or a ground source water supply 11B, or a dedicated normal temperature refrigeration system 11C (FIG. 2), a chiller system or recirculating water source 11D or a combination of such alternate fluid cooling sources to assure a continuous supply of coolant at a substantially constant temperature, as will be discussed more fully hereinafter.

Figure 2:
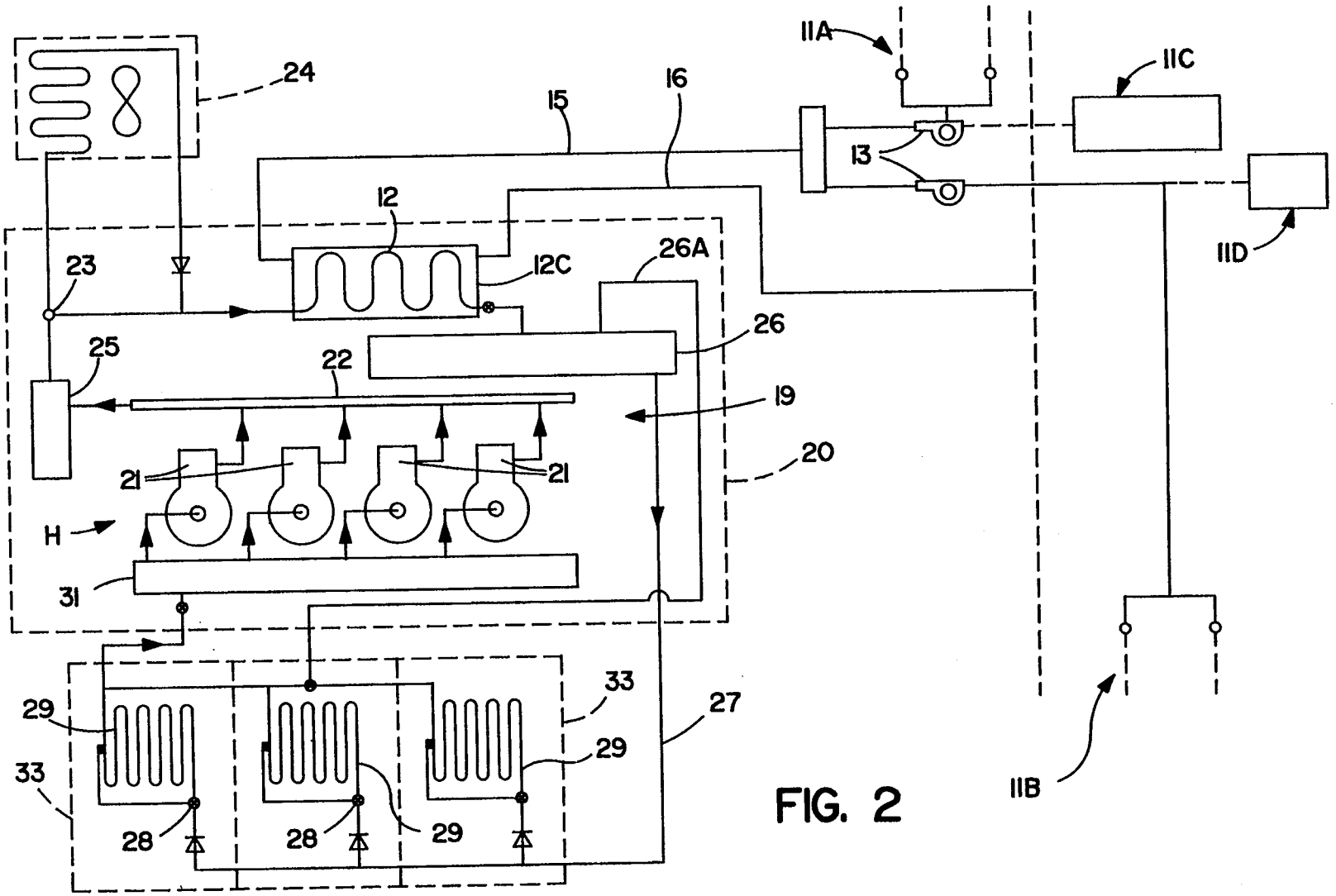
FIG. 2 is a schematic flow diagram of a typical modular refrigeration system unit and condenser cooling loop therefor.

The modular nature of the invention utilizes three basic variable forms of the refrigeration system unit 10: a vertical compressor configuration V, such as 10B (FIGS. 1, 5, 6); a horizontal compressor configuration H, such as 10C (FIGS. 1, 2, 4, 4A, 4B, 7, 7A, 8, 8A); and a combination or mixed horizontal and vertical compressor configuration M, such as 10F (FIGS. 1, 6A, 9, 10). Referring to FIG. 2, each of the modular system units 10 includes a condensing unit rack 20 constructed and arranged to mount and support the operative components of a closed refrigeration circuit 19 dedicated to the refrigeration load requirements of its associated discrete product zone, as will be described. Thus, a typical condensing unit rack 20 of the present invention may include a multiple of two to ten multiplexed compressors 21 connected by a discharge header 22 to a diverting valve 23 selectively connecting the discharge to a heat recovery means such as heat reclaim coil 24 or a hot water exchanger (not shown) or directly to the system condenser 12 located on the rack 20. An oil separator 25, such as the oil system described in U.S. Pat. No. 4,478,050, may be incorporated into the system 19 downstream of the discharge manifold 22, and a liquid receiver 26 may be connected to receive the condensate outflow from the condenser 12. The high side of the circuit 19 is thence connected by liquid lines 27 to the evaporative expansion valves 28 at each evaporator (29) associated with the discrete product cooling zone (33) to be cooled. On the low side, the refrigerant expands and vaporizes in the merchandiser evaporators 29 removing heat from the product zone 33 to maintain the preselected desired cooling. The outlets of the evaporators 29 connect to a common suction header or manifold 31 and thence to the suction side of the compressors 21 to complete the refrigeration circuit. It will be understood that these individual modular refrigeration system units 10 will generally include still other system components, such as defrost system means, system performance sensing and operating control panel and microprocessor apparatus, alarm systems and the like.

Figure 3:
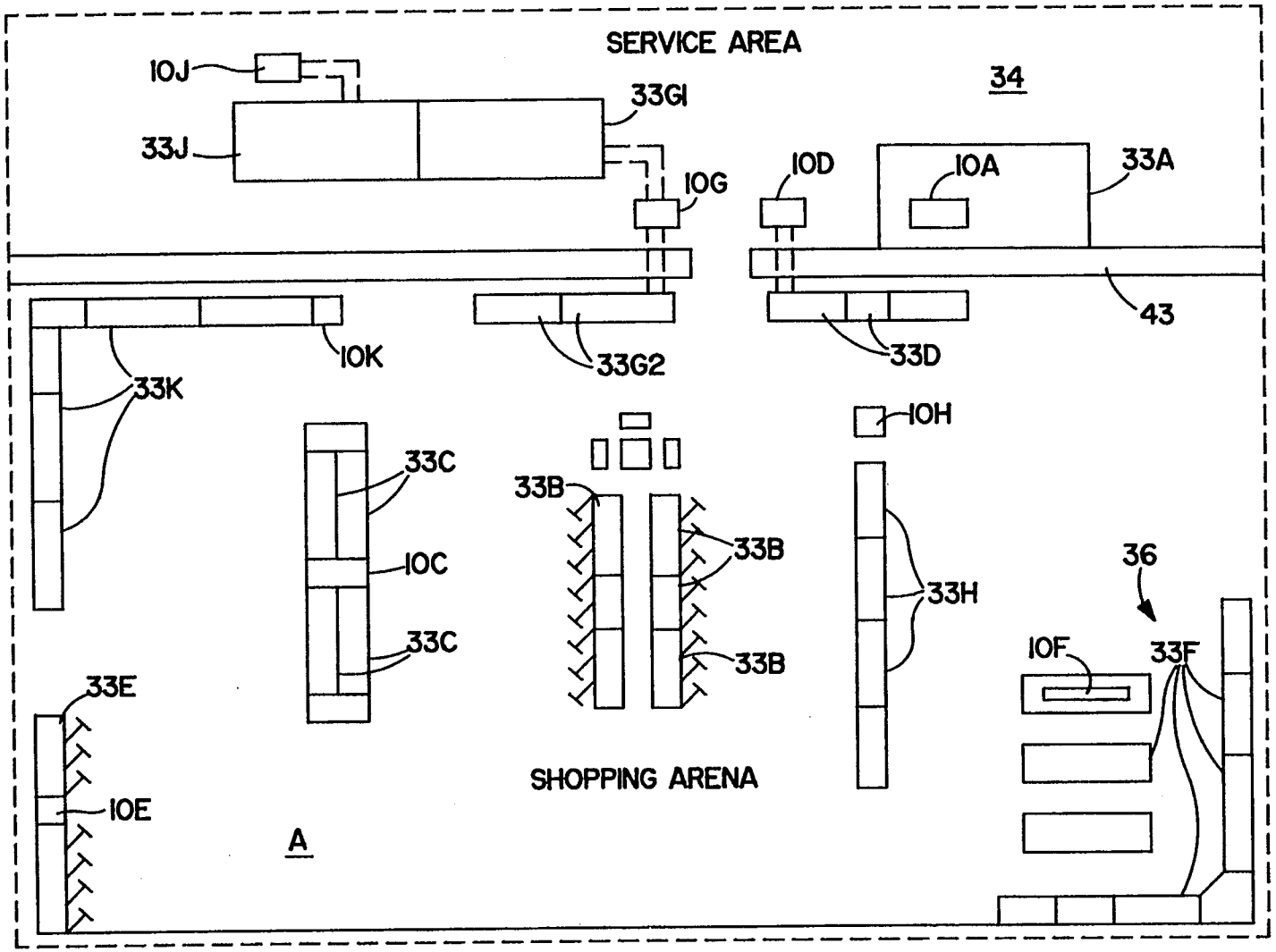
FIG. 3 is a representative supermarket floor plan illustrating the strategic placement of dedicated modular refrigeration system units relative to the respective refrigeration loads.

A principal feature of the invention is to place the modular refrigeration units 10 strategically throughout the supermarket in close proximity to the dedicated cooling zone (33) of an associated merchandiser department or case lineup in order to eliminate the traditional machine back room, long piping connections and large refrigerant requirements formerly required. Referring to FIG. 3, a typical supermarket floor plan diagrammatically illustrates the strategic deployment of refrigeration units 10 to carry out this objective. As shown, refrigeration unit 10A is a low temperature system dedicated to maintain frozen meat products in a meat freezer (cooling zone 33A) located in a service area 34 outside the shopping arena A; refrigeration unit 10B is a low temperature system for a dual back-to-back lineup of frozen food reach-in merchandisers 33B within the shopping arena (see also FIG. 5A); refrigeration unit 10C is low temperature system dedicated to maintain ice cream product temperatures of about −20° F. in twin island "coffin" type merchandisers 33C in the shopping area (see also FIGS. 7, 7A); refrigeration unit 10D is a medium temperature system located outside the shopping arena A, but immediately adjacent to its discrete service load of multi-deck meat merchandisers 33D in the shopping arena; refrigeration unit 10E is a medium temperature system for a lineup of non-frozen reach-in product fixtures 33E in the shopping arena A; refrigeration unit 10F is a medium temperature system servicing the produce department merchandisers 33F operating at temperatures in the range of 45° F. to 50° F. (see FIGS. 4, 4A); refrigeration unit 10G is a medium temperature system also located in the service area 34 outside the shopping arena, but constructed and arranged to service both a deli walk-in cooler 33G1 in the service area and a deli merchandiser lineup 33G2 in the shopping area A; refrigeration unit 33H is a medium temperature system for servicing a line of multideck produce merchandisers 33H (see FIG. 5); refrigeration unit 10J is a low temperature system dedicated to an ice cream walk-in freezer 33J in the service area 34; and refrigeration unit 10K is a medium temperature system associated with the dairy department lineup of multideck merchandisers 33K. Although not shown, it will be understood that a typical supermarket today may also include a refrigerated floral merchandiser, an in-store bakery with coolers and retarder units, a seafood department and other non-refrigerated departments, dry goods shelving, customer checkout area and the like. Thus, as seen in FIG. 3, the conventional compressor machine room of prior art supermarkets is eliminated in favor of the modular refrigeration units 10A–10K strategically located in and around the supermarket shopping arena. The refrigeration units are specifically dedicated to discrete refrigeration loads, and each strategic unit location is in close proximity to the associated group of storage or display merchandising zones operated at the same temperature and forming this discrete load.

Figure 4:
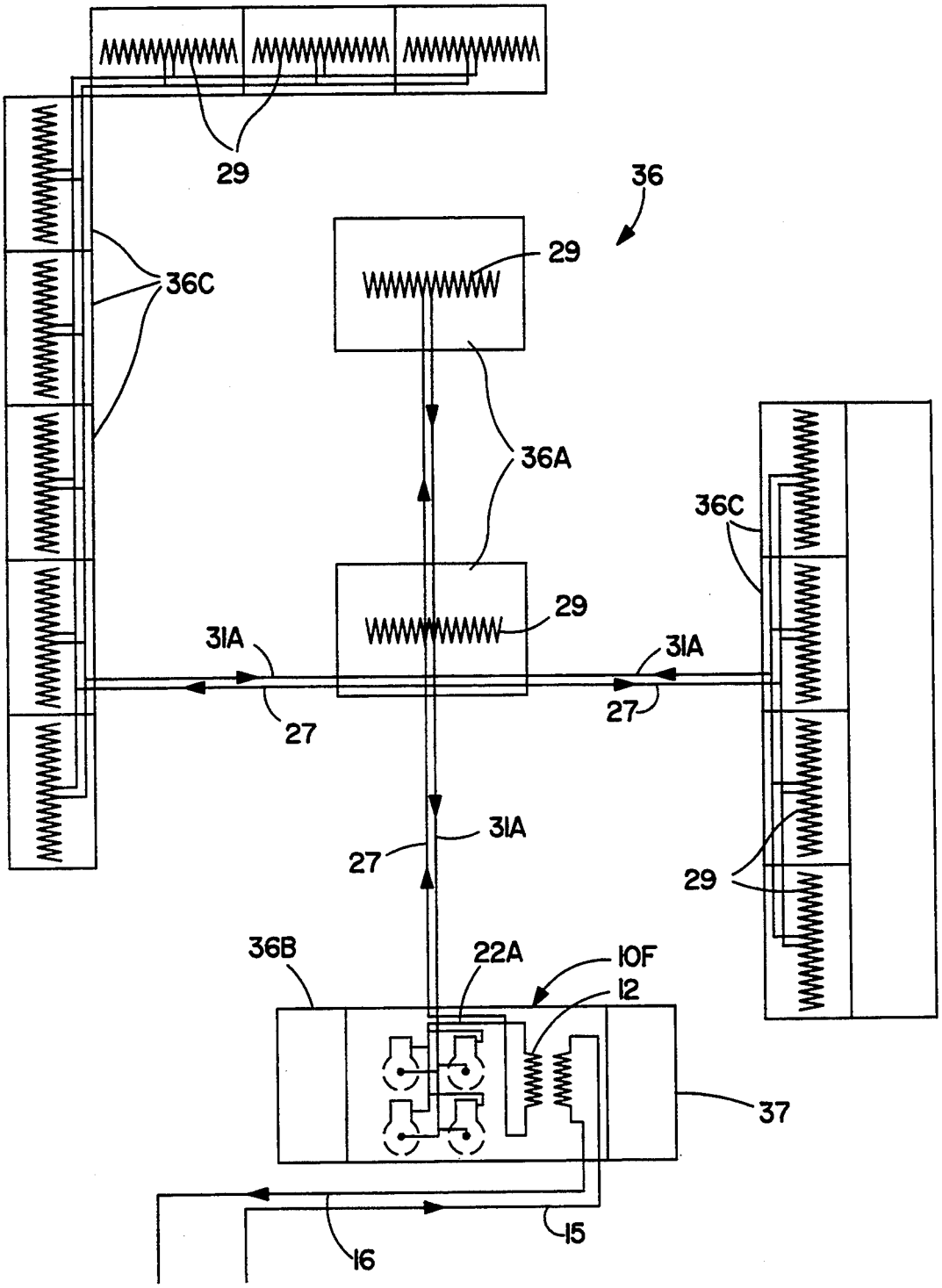
FIG. 4 is an enlarged supermarket floor plan illustrating a typical produce department and a dedicated modular refrigeration unit having a horizontal combination of multiplexed compressors.
Figure 4A:
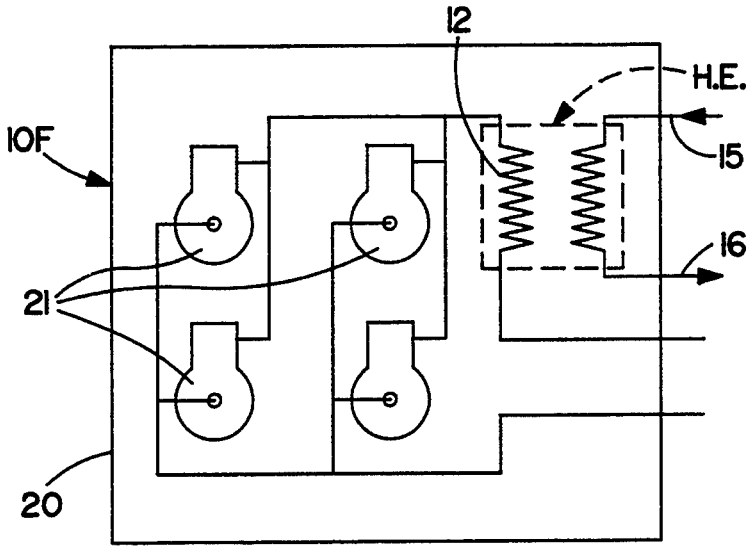
FIG. 4A is a top plan view of the refrigeration unit of FIG. 4 illustrating the heat exchanger network with a cooling liquid source.
Figure 4B:
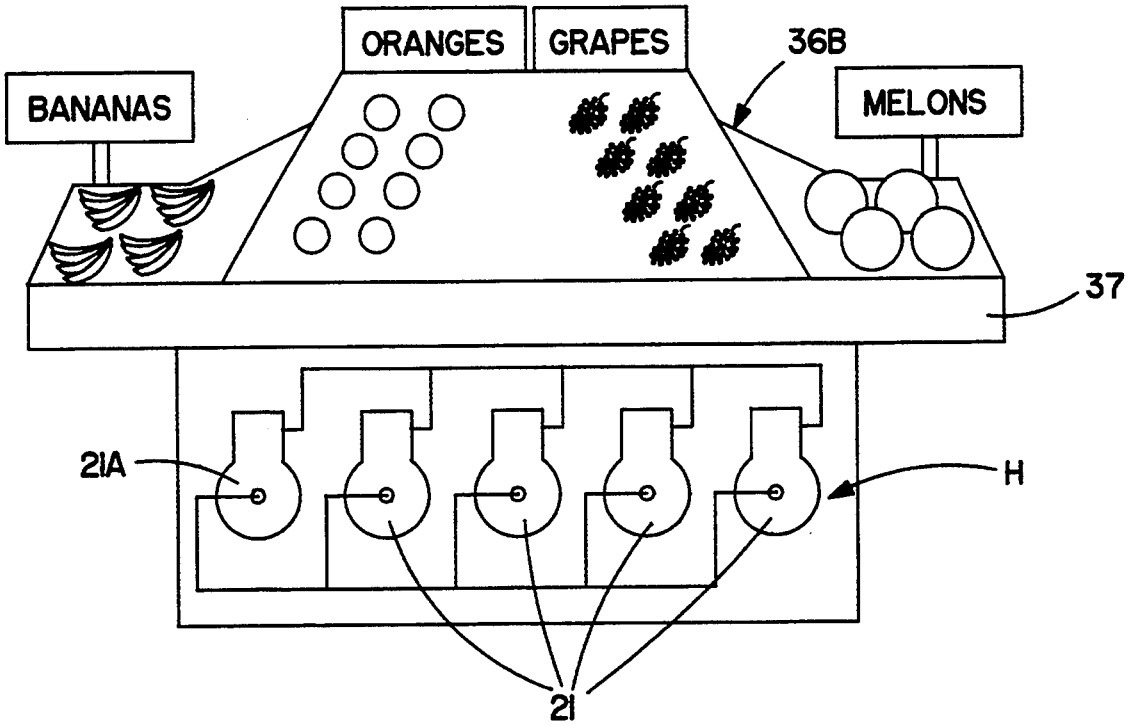
FIG. 4B is a diagrammatic end view of a horizontal produce case or table housing illustrating another horizontal form of the dedicated modular refrigeration unit for use in the FIG. 4 produce department.
Figure 5:
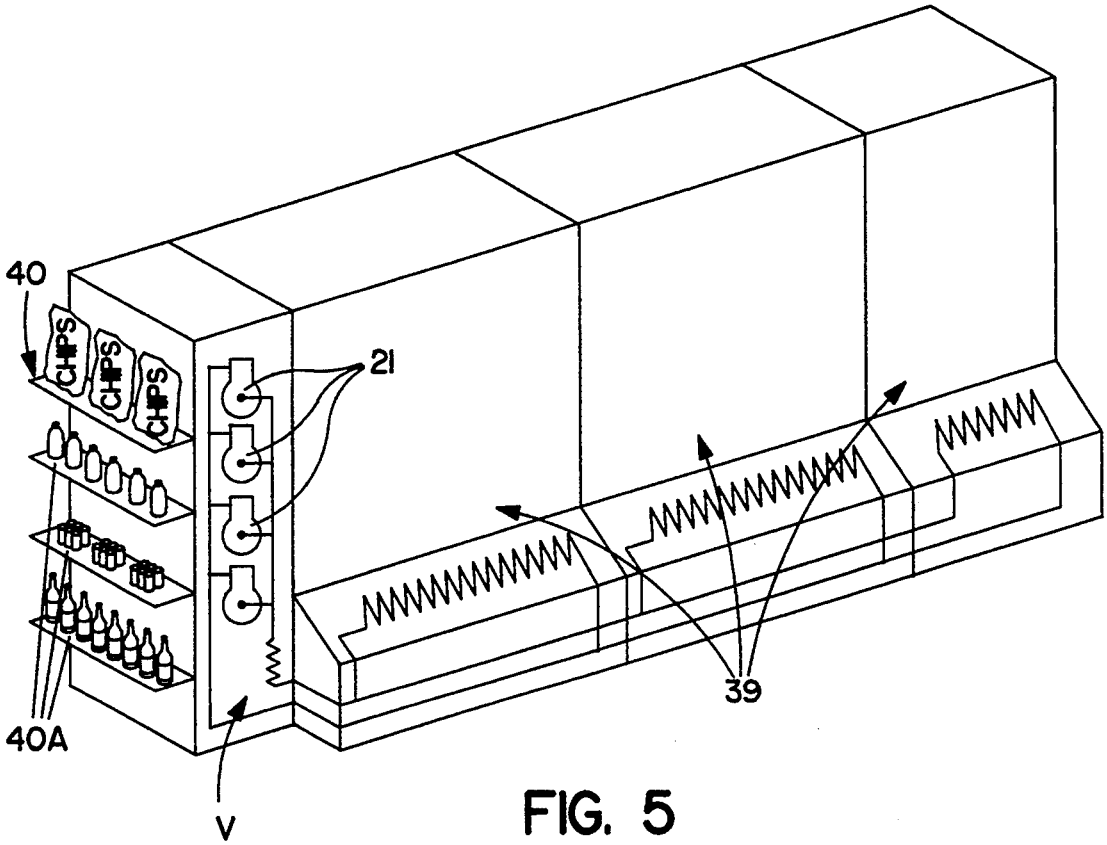
FIG. 5 is a diagrammatic perspective view showing a typical open front refrigerated merchandiser lineup and associated vertical modular refrigeration unit therefor.
Figure 8:
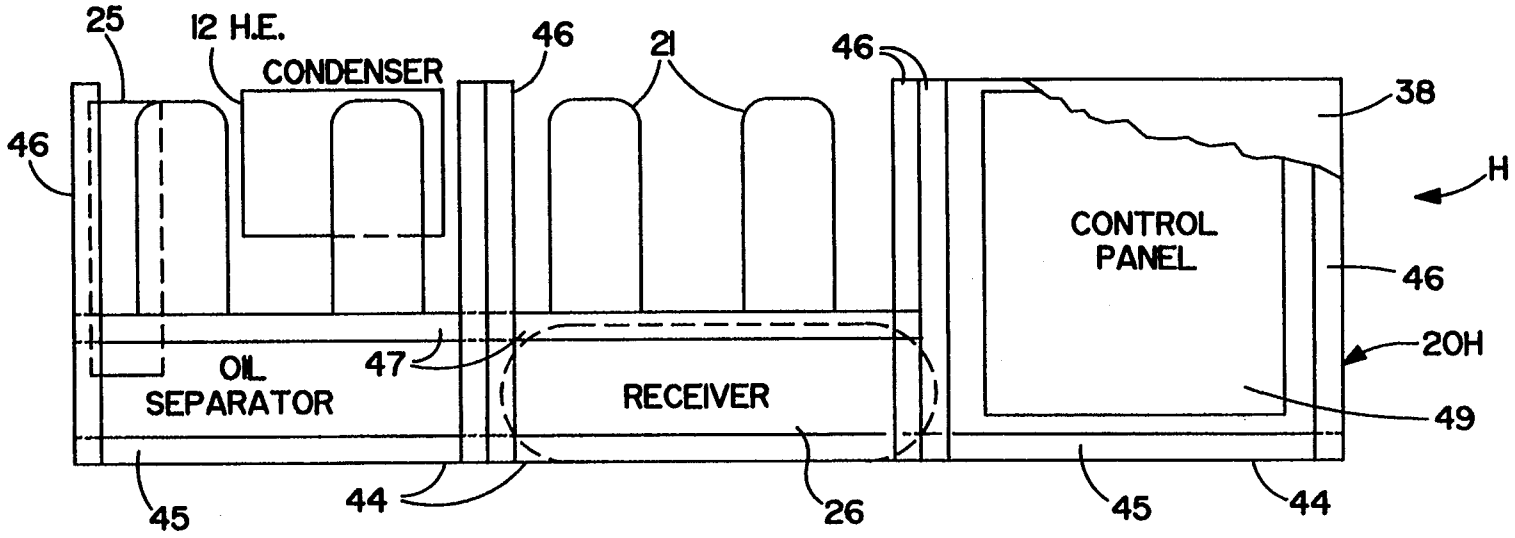
FIG. 8 is a diagrammatic side elevational view illustrating a modular condensing unit rack for a refrigeration unit with a horizontal compressor arrangement.
Figure 8A:
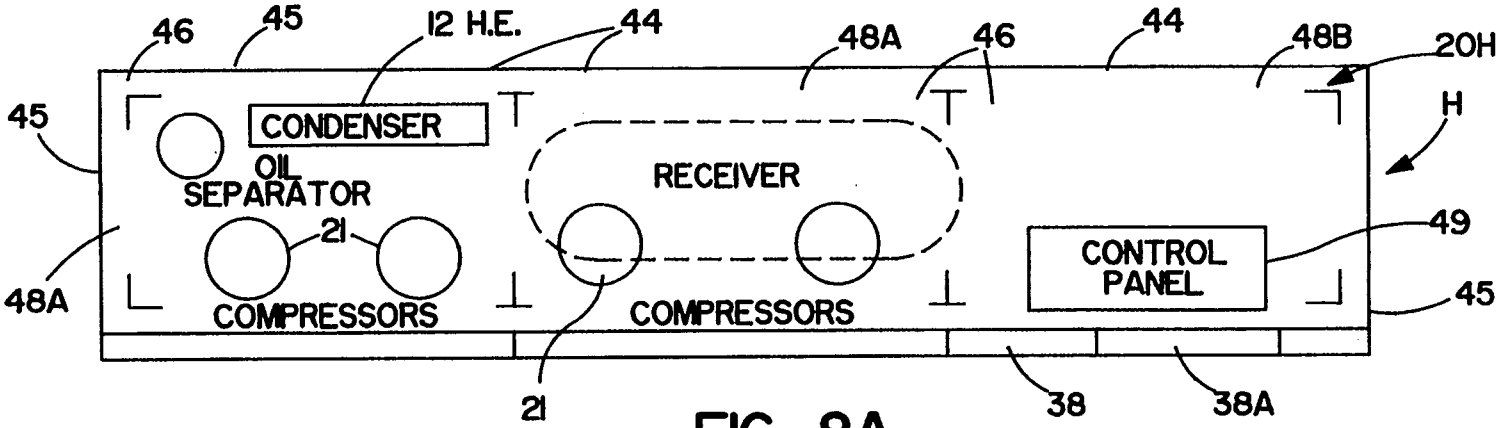
FIG. 8A is a diagrammatic plan view of the modular condensing unit rack of FIG. 8.

An example of one refrigeration unit 10F and its associated refrigerated zone 33F is shown best in FIGS. 4 and 4A. The cooling zone illustrated is the medium temperature produce section or department 36 of a supermarket and includes a plurality (two) of refrigerated produce tables **36*a*, one unrefrigerated produce table 36*b* (used for apples, potatoes or other produce not requiring refrigeration), and one or more lineups of multideck or gondola produce merchandisers 36*c*. The refrigeration unit 10F may be concealed in the base of the unrefrigerated produce table 36*b* or, alternatively, under one of the refrigerated tables 36*a* or in a merchandiser lineup 36*c*. In the FIG. 4, 4A arrangement, the condenser unit rack 20 is constructed and arranged to support four compressors 21 in a combination arrangement M of two pairs of horizontally disposed compressors in side-by-side relationship. FIG. 4A shows that the condenser 12F of the modular unit 10F is part of the heat exchanger H.E. containing a coolant loop having a cool coolant delivery mode (15) and a warm coolant return mode (16). FIG. 4B illustrates an enlarged elevation of the unrefrigerated table 36*b* and a horizontal compressor modular unit H (see FIG. 8) that can be accessed either by removing an insulated front closure panel 38 as shown in FIG. 8A, or by constructing and arranging the table top 37 to be hinged for vertical lifting movement on its base or for horizontal side movement thereon. In the FIG. 4B compressor arrangement, four of the compressors 21 can be multiplexed to operate cyclically or variably at the same suction temperature to keep the produce merchandiser temperatures constant, and one compressor 21*a*** may operate as a dedicated satellite with a different suction temperature to control a special discrete merchandiser refrigeration load, as will be understood by those skilled in the art.

Referring again to FIG. 4, a discharge conduit **22*a* connects the compressor head manifold 22 to the unit condenser 12 on the condensing unit rack 20, which connects (through the system receiver-accumulator 26 if present) to the liquid line conduits 27 which extend in short runs from the refrigeration unit 10F beneath the floor to the evaporators 29 in the closely adjacent respective tables 316*a* and merchandisers 36*c*. A suction conduit 31*a* returns the vaporized refrigerant liquid to the compressors 21. A coolant delivery line 15 from the remote cooling liquid source (11) may also be piped beneath the floor or overhead to the refrigeration unit 20 for removing the heat of rejection and compression from the unit condenser 12 in the heat exchanger and a coolant return line 16** is also provided to expell this heat to a location exterior of the supermarket.

Additional configurations of the compressors 21 accommodated by the modular condensing unit racks 20 and their associated discrete refrigeration loads are shown in FIGS. 5–7A. In each instance, all of the closed refrigeration circuit components are rack mounted except for the merchandiser or other zone evaporators 29 and associated refrigerant control and sensing means, such as expansion valves 28 and defrost control valves (to be described) as well as connecting discharge and suction lines between the evaporators and the system racks. The modular refrigeration units 10 may utilize the vertical unit V behind a shelving unit 40 for dry non-refrigerated goods that may be arranged to cover one side of the modular unit when positioned at the end of a merchandiser lineup, such as the open front multideck merchandisers 39 shown in FIG. 5. In this arrangement, the back panel of the shelving unit 40 may be insulated with sound absorbing material to inhibit transmission of noises generated by the compressors 21 and other system components on the condensing unit rack from traveling to exterior locations such as into the shopping arena A.

Figure 5A:
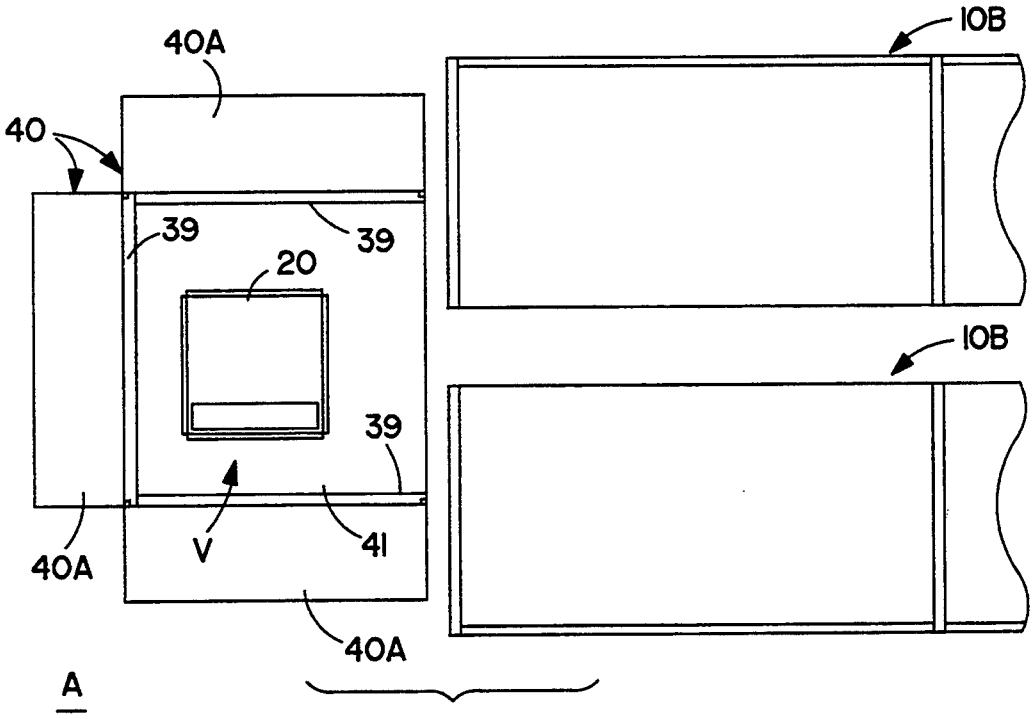
FIG. 5A is a plan diagram showing a modular refrigeration unit placement for a lineup of reach-in merchandisers.
Figure 10:
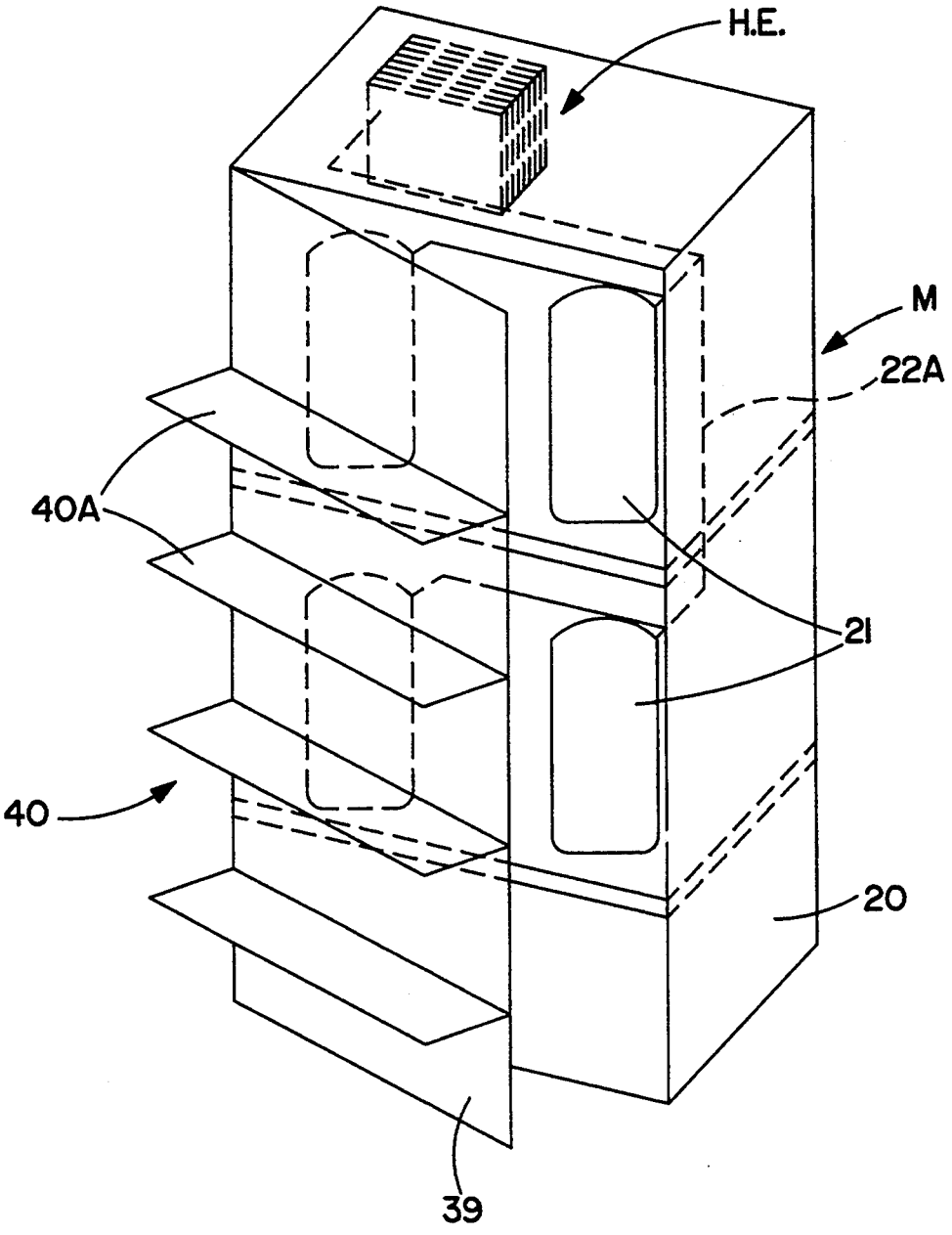
FIG. 10 is an enlarged diagrammatic view of a modular refrigeration system unit employing a combination arrangement of compressors and being associated with a swing-out dry goods shelf.

FIG. 5A illustrates a modified vertical unit V or combination unit M arrangement disposed at the end of a dual back-to-back lineup of reach-in merchandisers such as 10B that might be used for frozen foods or the like. In this arrangement, the modular refrigeration unit V is surrounded on three sides by shelving unit is 40, each of which may have an insulated rear panel 39 to confine refrigeration system noises to the unit area 41 enclosed by the shelving 40. As shown in FIG. 10, a combination modular unit M can be utilized in an end position on a case lineup and one of the shelving units 40 can be hingedly connected onto the condensing unit rack 20 to normally be in closed position on the rack to hide this system and soundproof it from the shopping arena. Clearly, such shelving unit 40 can be swung away to the open position shown in order to permit full access to the condensing unit rack 20 for service. Such shelving units 40 will typically have a series of vertically disposed shelves **40*a*** for the display of non-refrigerated products, such as snack foods and beverages, to best utilize available store space for merchandising purposes.

Figure 6:
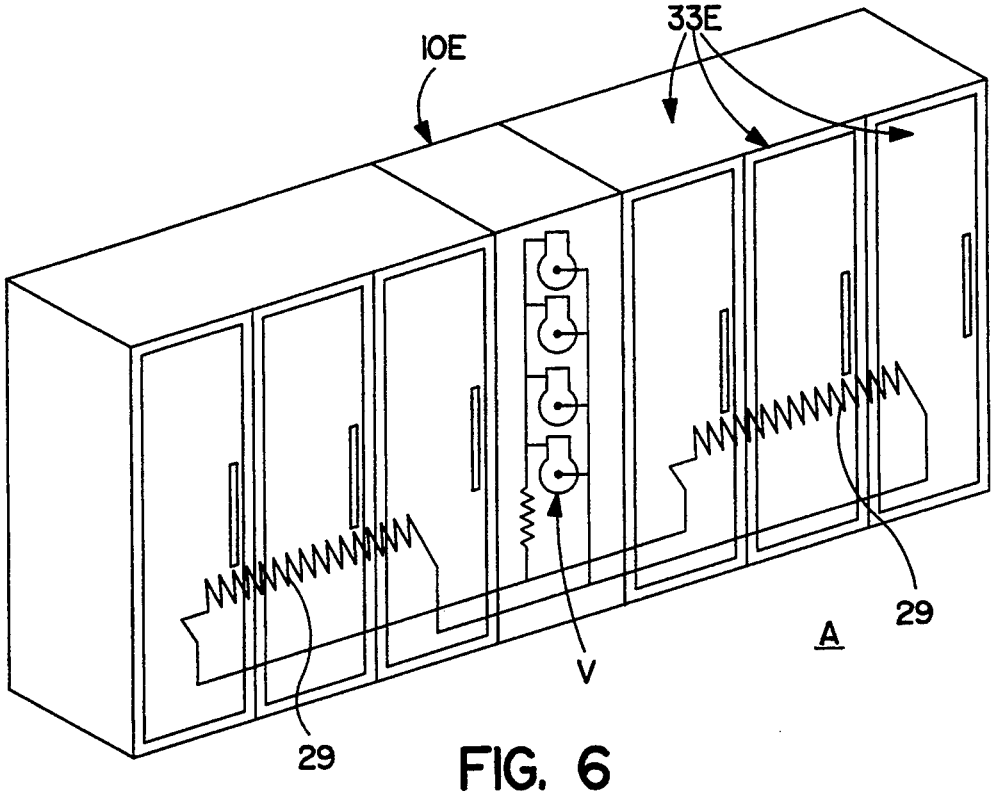
FIG. 6 is another diagrammatic perspective view showing a lineup of reach-in merchandisers strategically incorporating a vertical modular refrigeration unit.
Figure 6A:
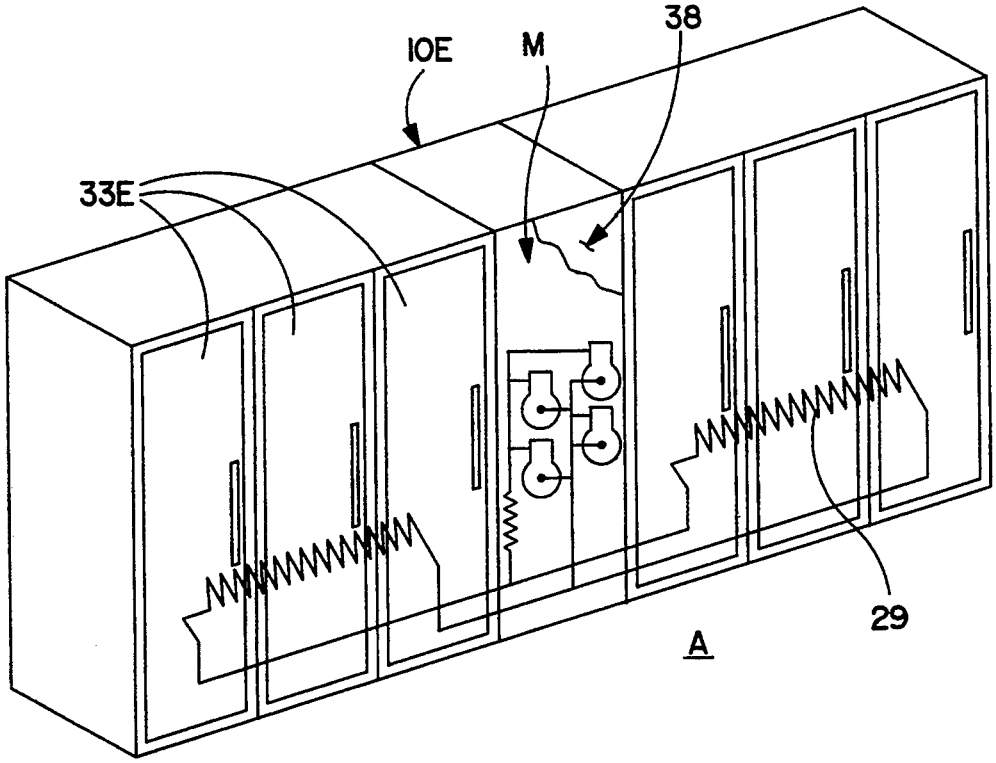
FIG. 6A is a view similar to FIG. 6, but showing a modular refrigeration unit having a combination horizontal and vertical compressor arrangement.
Figure 7:
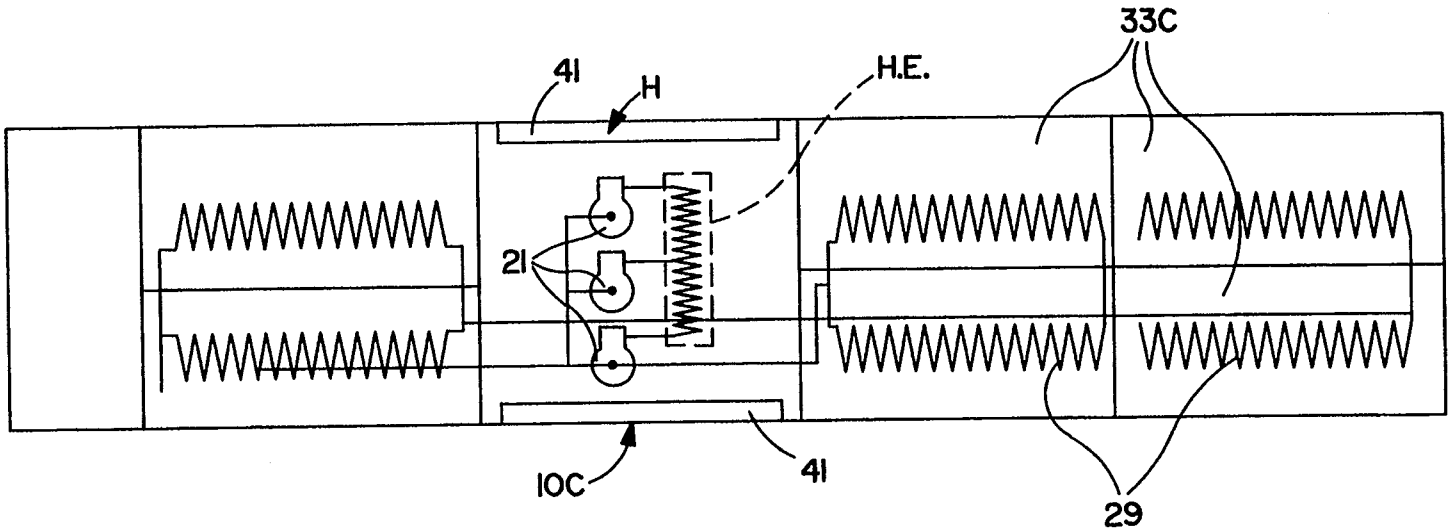
FIG. 7 is a plan view of a lineup of wide island cases showing a horizontal three compressor arrangement in the associated modular refrigeration unit.
Figure 7A:
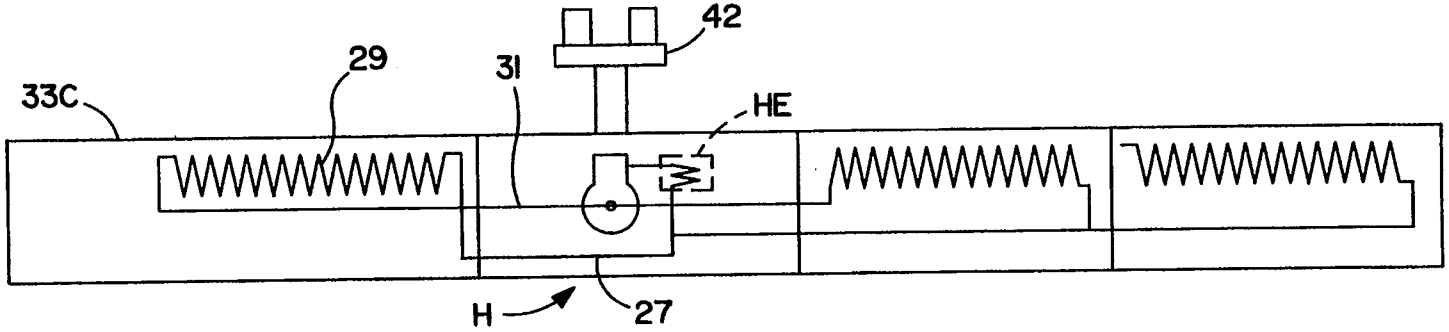
FIG. 7A is a side elevational view of the lineup of island cases of FIG. 7, but showing a shelving canopy mounted above the refrigeration unit.

FIGS. 6 and 6A show lineups of reach-in merchandisers, such as 33E in which modular units are interposed into the middle of the lineups, which assist in forming sound absorbing means. In FIG. 6, the modular unit V is a vertical compressor stack, and FIG. 6A shows a combination modular unit M. Such modular unit locations exemplify a major objective of this invention in offering a dedicated multiplexed compressor unit for a discrete predetermined set of merchandisers with minimal liquid and suction line runs. Clearly, an insulated or sound absorbent panel 38 would be provided over the otherwise exposed front side of the condensing unit rack 20, and it will also be understood that the front surface of this panel 40 will be exposed to the shopping arena A and therefore formed with a decorative appearance compatible with the adjacent merchandisers. It is in keeping with the invention that the front panel 38 in the FIG. 6 and 6A example may be recessed relative to the front glass doors of the reach-in cabinets 33E to accommodate a non-refrigerated shelving stack 40. FIGS. 7 and 7A illustrate another alternate configuration of the horizontal compressor unit H centrally located between parallel rows or twin island coffin merchandisers 33*c* of the type used for ice cream or other frozen products. The three compressors 21 are arranged on an horizontal line in this modular unit 10C and, again, at least one exterior side of the condensing unit rack 20 will have a removable panel 41 that can be replaced after service. As shown in FIG. 7A, shelving 42 is mounted vertically above the top of the location of the refrigeration unit for displaying related non-refrigerated products.

The location of the modular refrigeration units (10), whether in the shopping arena A or behind a wall 43 just outside the shopping arena as in the service area 34 where storage coolers and freezers 33A and 33J and other warehousing and employee stations are located, are in close proximity to the associated refrigerations loads serviced by the respective units to thereby greatly reduce the amount of refrigerant needed. The refrigeration network of the present invention requires about 40%–50% less refrigerant than conventional back room systems in which great lengths of refrigerant lines extend great distances all over the store to the merchandiser fixtures. The length of piping needed to carry the refrigerant to all of such fixtures in the supermarket is reduced by about 75%. A reduction in the length of piping reduces the deleterious effect of expansion of the pipes as conventionally occurs during a hot gas defrost of the fixture evaporators so leaks are less likely to occur than heretofore. Moreover, if a leak occurs in one modular refrigeration unit, it is only possible to lose the refrigerant from that one closed circuit unit so the potential damage to the environment and the cost of replacing refrigerant are substantially reduced. In addition, in the preferred embodiments, conventional CFC refrigerant (e.g., R-12 and R-502) are replaced with HP-62, a hydrofluorocarbon (HCFC) which is environmentally acceptable. Although the coolant delivery and return conduit loops for the remote liquid cooling source (11) are piped to extend throughout the store to all of the modular refrigerated units (10), this is also an acceptable practice. The conduit for the liquid coolant is not subject to temperature changes as in refrigerant conduits since the cool coolant delivery mode and the heated coolant return mode will be at substantially constant operating temperatures, and further the leakage of water or glycol coolants is neither as environmentally hazardous nor as costly to replace as refrigerant.

The modularity of the condensing unit racks 20 for forming the respective variant refrigeration unit arrangements H, V and M will be described with reference to FIGS. 8, 8A and 9. As shown in FIGS. 8 and 8A, the condensing unit rack 20H for the horizontal compressor unit H is comprised of a series of similar frame modules 44 each of which has a main frame comprised of lower or first level horizontal structural members 45 forming a rectangular base and vertical struts or stanchions 46 located at the corners of the base (45). In the four compressor arrangement of FIGS. 8 and 8A, three frame modules 44 are joined together, and the two leftward modules also include upper or second level horizontal structural members 47 secured to the vertical stanchions 46 in spaced relation above the lower base level 45. Each frame module 44 is provided with a horizontally extending metal support or mounting plate (48) that is preformed to receive and secure specific components of the closed refrigeration system. In FIGS. 8 and 8A, the lefthand mounting plates 48*a* are each constructed and arranged to mount two compressors 21. It will also be clear that the condenser/heat exchanger 12 H.E. and the oil separator 25 and receiver 26 are accommodated by the modular rack arrangement. The righthand unit 48*b* is designed to mount a control panel 49 for operating the associated refrigeration system of the modular unit. It will again be noted that at least one side wall of the modular rack assembly is provided with a sound absorbent panel 38 that may include an opening 38*a* for direct access to the control panel 49 without removing the entire cover panel 38.

Figure 9:
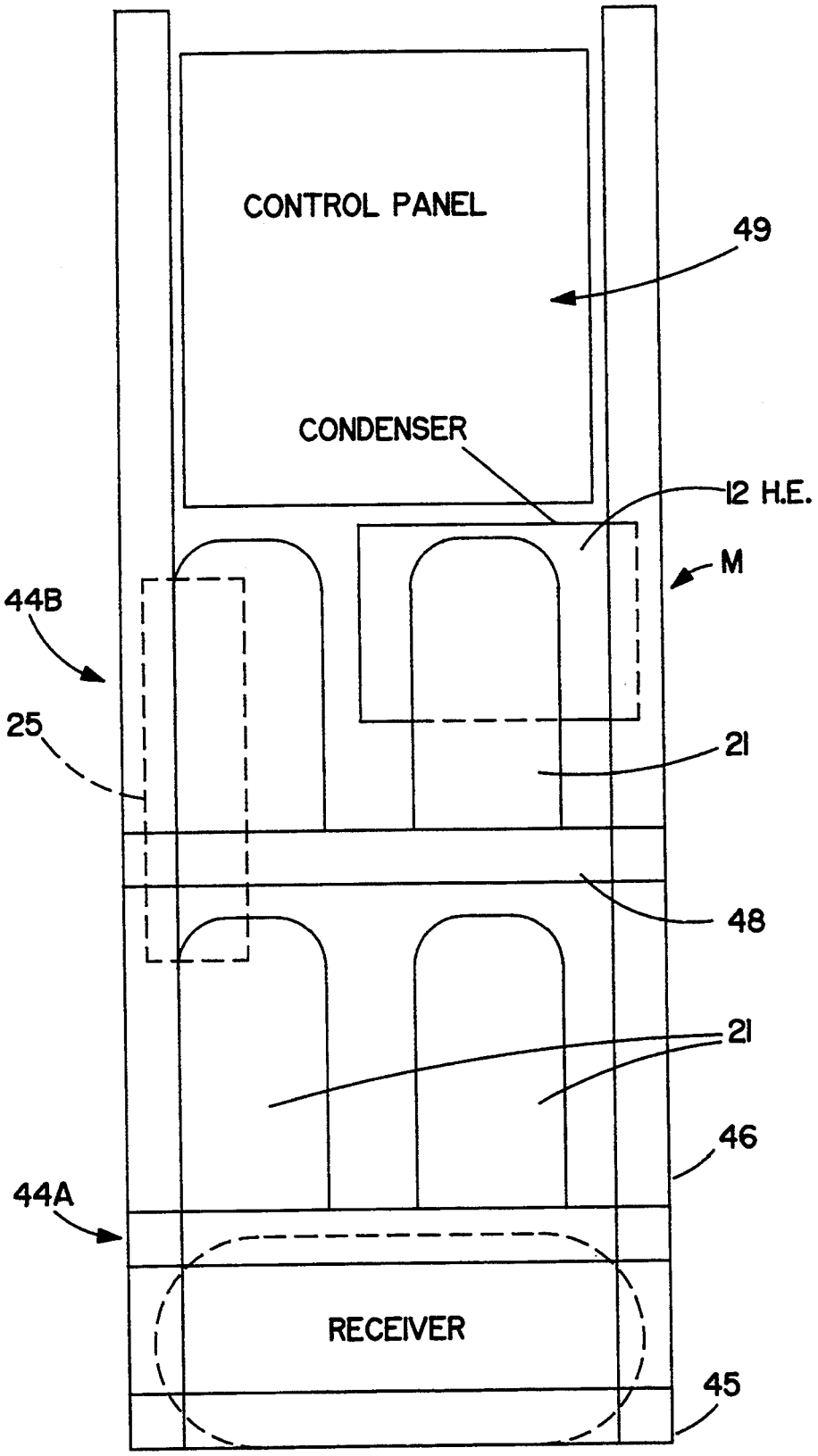
FIG. 9 is a diagrammatic front elevation view illustrating another modular condensing unit rack showing a combination arrangement of the compressors.

Referring now to FIG. 9 showing a combination compressor unit M, the same basic frame module 44A of FIG. 8 is used including the lower level horizontal base frame 45 with vertical struts 46 and a second level frame 47 carrying a mounting plate 48 for supporting a pair of compressors 21. Another frame module 44B is stacked on top of the first module 44A and mounts another pair of compressors 21.

The modularity of the condensing rack units (10) reduces the time and cost of installing. the refrigeration system network and simplifies service, as compared to conventional back room refrigeration systems. It is not necessary to construct a machine (back) room to house the massive prior art compressor systems or construct the complex piping runs from such a remote system. Moreover, since the alternate configurations of the refrigeration units are pre-designed, less field assembly of conduit joints are required. Pre-bent tubing (See 22A in FIG. 10) may be factory assembled with easy installation into the modular units. The reduction of field joints helps to prevent refrigerant leaks and service problems.

It is understood that the condensing unit rack configurations shown in FIGS. 8 and 9 are illustrative only, and that the rack 20 may assume other configurations such as the vertical compressor arrangement in which single compressors 21 are stacked one above the other in a tier that affords a minimum floor space footprint and excellent accessibility for service. The flexibility in, the modular refrigeration system units permits these dedicated units 10 to be located unobtrusively within the shopping arena A of a supermarket in such a way as to blend with the closely adjacent configurations of refrigerated product storage coolers and display merchandisers having the associated cooling zones. The placement of the refrigeration units (10) in the shopping arena A is commercially feasible only if the noise from the compressors is substantially eliminated or reduced to acceptable decibel levels. it is desirable that the aggregate noise level from the compressors of all modular units (10) have no greater audibility to shoppers than the usual background noise of the supermarket (e.g., 60 to 65 dB). In that regard, the preferred compressors 21 of the present invention are preferably rotary compressors or scrolls which can operate efficiently within the envelope of −35° F. to 40° F. at a range of 50° F. to 90° F. condensing temperature and with 20° F. superheat.

As briefly described with reference to FIG. 1, the modular refrigeration units (10) in the supermarket derive their respective condenser cooling from a common liquid cooling source (11) remote from these modular refrigeration units in the shopping arena A. The circulation of a controlled coolant in a heat exchange relationship with the unit condensers provides optimum condensing and refrigeration efficiency of the evaporators in cooling their respective product zones. The liquid cooling source (11) circulates a cooling liquid, such as chemically treated water or a glycol solution, via circulation pumps 12 in a cool coolant distribution mode to the condensing racks. Preferably, the heat exchanger H.E. is of the plate-to-plate type for optimal heat transfer of the heat of rejection transferred from the product zone through the unit condensers 12 to the coolant, which thence carries the cumulative heat load in a heated coolant return mode for dissipation externally of the shopping arena A. It will be understood that this heat of rejection, together with the heat of compression from the compressors can be utilized for seasonal heating of the supermarket. FIG. 2 shows a unit heat reclaim coil 24 as part of the closed refrigeration circuit of this unit. Such a coil 24 is usually housed in a conventional store air handler (not shown) for seasonal air conditioning and environmental heating of the store, but may be located remotely as a water heating unit (not shown). Due to the modularity of the refrigeration units and their proximate location to the cooled product zones they service, it is contemplated that unit heat reclaim coils 24 may be strategically located under selected merchandisers or the like for environmental shopping arena heating, such as floor level heating to thereby eliminate cold aisles that may be a problem due to refrigerated air curtain fallout from open front multideck merchandisers, such as fixtures 39 in FIG. 5. in any event, it will be understood that a heat reclaim coil 24 is typically designed to function as a pre-condenser in that it removes heat from the compressed vaporous refrigerant on the high side upstream of the system condenser, but does not reduce this refrigerant vapor to its saturated condensing temperature (e.g., 70° F.) which is the final function of the condenser 12 at the unit heat exchanger H.E. Therefore, regardless of seasonal or selective heat reclaim operations, there will still be a substantial cumulative heat load imposed on and carried by the returning coolant. Thus, it is a further feature to utilize a return manifold 17 as a coolant pre-conditioner to dissipate a substantial portion of this cumulative return heat load either in a store heating (heat reclaim) mode or an air conditioning reheat mode to slightly elevate the A.C. temperature and thus dehumidify the air distributed to the store environment. In a third mode the cumulative coolant heat may be rejected in the pre-conditioner 17 in advance of coolant recirculation in a closed loop through its primary cooling stage as in the cooling tower 11A. Referring again to FIGS. 1 and 2, alternate cooling sources (11) for controlling or maintaining a substantially constant delivery temperature in the coolant including a typical cooling tower 11A, which may be a water-cooled cooling tower of the evaporative spray type or the fluid bed type, or a cooling tower having an air-cooled fluid heat exchanger. An alternative cooling source may be an open or closed ground source water supply 11B which may utilize a coolant sump (not shown) for obtaining optimum cooling or a closed ground loop (as will be understood), dedicated normal temperature refrigeration system or heat pump 11C may be utilized, or a refrigeration chiller or commercial city water supply 11D may be used. The selection of a particular coolant source, or combination of alternate sources, may be determined by a variety of factors including environmental impact (in case of open loop water systems), installation and operating costs, and local climate or other seasonal ambient environment conditions.

Still referring to FIG. 2, the closed refrigeration circuit 19 of the unit H also includes a latent heat gas defrost system for defrosting the evaporators 29. The general configuration of this gas defrost system is conventional with a saturated gas take-off 26*a* from the top of receiver 26. This type of defrost is fully disclosed in Quick U.S. Pat. No. 3,343,375—the disclosure of which is incorporated by reference, which also references prior art problems and practices of hot gas defrosting that still can be utilized as an alternative in certain closed refrigeration systems today. It is also understood that other conventional defrost arrangements may be selectively used for the evaporators 29 of different merchandisers. For instance, in produce merchandisers where the evaporators operate at barely frosting temperatures, off-cycle defrost is an accepted industry practice. Electric defrost means (not shown) is also well-known and frequently preferred in some merchandiser fixtures. In open front, air curtain merchandisers, reverse air flow may be used as a defrost alternative to the direct introduction of heat into the merchandiser as with electric and gas defrost systems.

Another feature of the modular refrigeration unit (10) is that a single electrical junction to the condensing unit rack permits the connection of all system components as well as local wiring control over the ancillary merchandiser electrical equipment (lighting, fans, antisweat heaters) for wiring from the same location. Only a single power circuit is required to extend from a remote power source (not shown) to the unit junction box usually associated with the control panel (49). In the preferred embodiment, the junction box is connected to the control panel which contains a remotely activated contactor and circuit breaker system for providing distributed electrical power via. buss arrangement to the electrical components in the system. Each of the modular refrigeration units (10) in the supermarket is monitored and controlled by a personal computer linked to a microprocessor within the control panel 49. The control system is conventional, except that the compressors are located around the supermarket, and are supplemented by individual control systems (i.e., microprocessors) associated with each rack. Interrogation of individual units to diagnose problems and override of the general control functions for purposes of testing and repair is accomplished at the specific refrigeration units. To reduce duplication of components such as visual systems readouts on each control panel, it is envisioned that a hand-held monitor would be used to plug into the microprocessor and provide a visual readout of its settings and conditions.

It will be readily apparent that the modular refrigeration units of the present invention provide a greatly improved, environmentally sound refrigeration network integrated with a master coolant circulating system. The scope of this invention is intended to encompass such changes and modifications as will be apparent to those skilled in the art, and is only to be limited by the scope of the claims which follow.

What is claimed is:

1. A modular commercial refrigeration unit constructed and arranged for placement in strategic proximity to plural associated product cooling zones within the shopping arena of a food store, said refrigeration unit comprising a condensing unit rack configured to accommodate the maximum refrigeration loads of the associated zones and having an optimum floor space footprint in the shopping arena, said condensing unit rack being constructed to support the components of a closed refrigeration circuit including a plurality of multiplexed compressor means, condenser means and associated high side and low side refrigerant delivery and suction means extending from the rack and being operatively connected to evaporator means constructed and arranged for cooling the associated zones, and another cooling source remote from said refrigeration unit but operatively constructed and arranged to provide a heat exchange relationship with said condenser means for providing optimum condensing and efficiency of said evaporator means in cooling the associated zones.

2. The modular refrigeration unit of claim 1, in which said condensing unit rack is configured to accommodate two to ten separate compressors at predetermined rack positions, and said other components have predetermined rack positions relative to said compressors.

3. The modular refrigeration unit of claim 2, in which said compressors are sized in the range of a fractional horsepower up to about ten horsepower, and are constructed and arranged to provide a variable refrigeration capacity balanced to the refrigeration loads imposed by the associated product zones.

4. The modular refrigeration unit of claim 3, in which said compressors are of a rotary type constructed and arranged to operate at low noise and vibration levels.

5. The modular refrigeration unit of claim 4, in which said compressors are scroll compressors.

6. The modular refrigeration unit of claim 2, in which said condensing unit rack configuration accommodates the placement of said compressors in horizontally disposed relationship.

7. The modular refrigeration unit of claim 2, in which said condensing unit rack configuration accommodates the placement of said compressors in a vertically disposed relationship.

8. The modular refrigeration unit of claim 2, in which said condensing unit rack configuration accommodates the placement of said compressors in a combination of horizontally and vertically disposed relationships.

9. The refrigeration unit of claim 2 wherein said high side and low side refrigerant delivery means of the closed refrigeration circuit includes conduit means of preselected configuration constructed and arranged to extend between and connect together said compressors, condenser means and other rack mounted components.

10. The refrigeration unit of claim 2 wherein said condensing unit rack comprises a main frame and support platform means thereon, the main frame and said support platform means being preformed to accommodate selective placement of a variable number of the compressors in predetermined horizontal, vertical and combination configurations on said support platform means.

11. The refrigeration unit of claim 10 wherein the support platform means comprises at least two support platform panels mounted on the main frame at vertically spaced levels and accommodating said compressors in vertically disposed relationships.

12. The refrigeration unit of claim 1, in which at least one of said associated zone comprises a refrigerated merchandiser incorporating said evaporator means and additionally incorporates refrigerant control means and refrigeration sensing means associated with said evaporator means, and wherein the condensing unit rack is constructed and arranged to mount the closed refrigeration circuit components except for said evaporator means and its associated refrigerant control and sensing means.

13. The refrigeration unit of claim 1, in which said condenser means is incorporated into a heat exchanger having a coolant flow relationship with the remote cooling source, and said heat exchanger and condenser means being mounted on the condensing unit rack.

14. The refrigeration unit of claim 13, in which coolant is delivered from the cooling source to the heat exchanger in a cool coolant delivery mode and heated by the heat of rejection from said condenser means to be carried away from the heat exchanger in a heated coolant return mode.

15. The refrigeration unit of claim 13 wherein the closed refrigeration circuit components further include receiver means mounted on said condensing unit rack and receiving condensate outflow from said condenser means for accumulating a supply source of liquid refrigerant for the evaporator means.

16. The refrigeration unit of claim 14 wherein said receiver means also forms a source of refrigerant vapor at saturation temperature for use in latent gas defrosting of said evaporator means.

17. The refrigeration unit of claim 13 wherein the closed refrigeration circuit components further include oil separation means mounted on said condensing unit rack and being constructed and arranged for separating lubricating oil from the refrigerant in the high side refrigerant delivery means for return to said compressor means.

18. The refrigeration unit of claim 1 wherein the closed refrigeration circuit components further include a control panel mounted on said condensing unit rack and being constructed and arranged for independently controlling refrigeration and defrosting function modes of said closed refrigeration circuit.

19. The refrigeration unit of claim 18, in which the defrosting function mode of the closed refrigeration circuit is selected from a class of evaporator defrosting arrangements consisting of electric, hot gas, latent gas, reverse cycle, off time and ambient air defrost.

20. The refrigeration unit of claim 1, and further comprising sound absorbing closure means for enclosing at least one side of the condensing unit rack, said sound absorbing closure means being constructed and arranged for inhibiting transmission of noise generated by the compressor means and other refrigeration circuit components at the condensing unit rack into the adjacent area of the shopping arena.

21. The refrigeration unit of claim 20 in which the components of said closed refrigeration circuit further include a control panel for controlling the refrigeration functions thereof, and said sound absorbing closure means being constructed and arranged for accessing said control panel.

22. The refrigeration unit of claim 20 wherein said sound absorbing closure means comprises at least one insulating panel movable between an open position in which the condensing unit rack is exposed for access to closed refrigeration circuit components thereon and a closed position in which the one side of the condensing unit rack is covered by the one insulating panel.

23. The refrigeration unit of claim 22 wherein at least said one insulating panel is exposed to the shopping arena and is formed with an externally decorative appearance visible from the shopping arena.

24. The refrigeration unit of claim 22 wherein said insulated panel is constructed and arranged with a rigid shell having sound absorbing material thereon.

25. The refrigeration unit of claim 20 wherein said sound absorbing closure means is associated with shelving means for storing and displaying non-refrigerated products in said shopping arena.

26. The refrigeration unit of claim 20 wherein said compressor means includes reciprocating compressors on said condensing unit rack, and said sound absorbing closure means comprises a plurality of insulating panels having sound absorbing material, the panels being constructed and arranged for enclosing the condensing unit rack to inhibit transmission of noise from the closed refrigeration circuit components mounted thereon into the shopping arena, and at least one of the insulating panels being movable from said rack enclosing position to an open position for accessing the condensing unit rack and the closed refrigeration circuit components thereon.

27. The refrigeration unit of claim 1, further comprising an electrical junction associated with said condensing unit rack and having a power input circuit from a remote power source, the electrical junction being constructed and arranged for providing distributed electrical power to said compressor means and other electrical components of the refrigeration unit.

28. The refrigeration unit of claim 26 wherein at least some of the insulating panels are exposed to the shopping arena and are formed with an externally decorative appearance visible from the shopping arena.

29. The refrigeration unit of claim 1, in which the cooling source for providing coolant heat exchange relationship with said condenser means is selected from a class consisting of a cooling tower, a cold ground water supply, a dedicated normal temperature refrigeration system, a coolant refrigeration chiller system, a commercial recirculating water supply, and an air-cooled heat exchanger.

30. The refrigeration unit of claim 1, in which the cooling source for providing coolant heat exchange relationship with said condenser means is an evaporative cooling tower.

31. The refrigeration system of claim 1, in which the cooling source is a fluid cooler cooling tower.

32. The refrigeration unit of claim 1, in which the coolant source for providing coolant heat exchange relationship with said condenser means is an air cooled heat exchanger.

33. The refrigeration unit of claim 32, in which said air cooled heat exchanger is part of a dedicated normal temperature refrigeration system.

34. The refrigeration unit of claim 1, in which the cooling source for providing coolant heat exchange relationship with said condenser means is a cold ground water supply.

35. The refrigeration system of claim 34, in which the cold ground water supply has a closed system ground loop.

36. The refrigeration unit of claim 1, in which the coolant source is located outside the shopping arena of the supermarket.

37. A modular food store refrigeration system comprising: at least two refrigerated fixtures having first closely adjacent locations in the store, a first stage evaporator coil for cooling each of the refrigerated fixtures to maintain food products therein within a predetermined temperature range; at least two multiplexed scroll type first stage compressors having a second location in the store in closely adjacent proximity to the first locations of the refrigerated fixtures, and first stage condenser means connected together with said first stage compressors and said first stage evaporator coils to form a first stage closed loop refrigeration circuit; an exterior heat exchange device located in a remote environment outside the store for transferring heat to the exterior atmosphere; and a closed liquid heat transfer loop extending between the first stage closed loop refrigeration circuit and the remote environment and interconnecting the exterior heat exchange device and the first stage condenser means in continuous communication to transfer heat from the first stage condenser means to the exterior heat exchange device.

38. A supermarket refrigeration network comprising:

a first modular refrigeration system unit in close strategic proximity to a first refrigerated product zone, and including a first condensing unit rack comprising first closed refrigeration circuit components including plural multiplexed compressor means, condenser means and associated high side and low side refrigerant delivery and suction means operatively connected to first evaporator means for cooling said first refrigerated zone;

a second modular refrigeration system unit in close strategic proximity to a second refrigerated product zone, and including a second condensing unit rack comprising second closed refrigeration circuit components including plural multiplexed compressor means, condenser means and associated high side and low side refrigerant delivery and suction means operatively connected to second evaporator means for cooling said second refrigerated zone;

other modular refrigeration system units in close strategic proximity to associated other refrigerated product zones, and each including another condensing unit rack comprising other closed refrigeration circuit components including plural multiplexed compressor means, condenser means and associated high side and low side refrigerant delivery and suction means operatively connected to other evaporator means for cooling the respective other refrigerated zones; and a coolant circulating system having a plurality of heat exchanger circuits in heat exchange relationship with the respective first, second and other condensing means at the respective first, second and other refrigeration system unit racks, said coolant circulating system having at least one continuous cooling source for the coolant in said circulating system.

39. The refrigeration network of claim 38, in which the cooling source for providing coolant to said unit heat exchange circuits is selected from a class consisting of a cooling tower, a cold grounds water supply, a dedicated normal temperature refrigeration system, a coolant chiller system, a commercial recirculating water supply, and an air-cooled heat exchanger.

40. The refrigeration network of claim 38, in which the coolant circulated to said unit heat exchange circuits is selected from a class consisting of a glycol solution and a chemically treated water solution.

41. The refrigeration network of claim 38, in which the cooling source for the coolant is an evaporative cooling tower.

42. The refrigeration network of claim 38 in which the cooling source for the coolant is a fluid cooler cooling tower.

43. The refrigeration network of claim 38, in which the cooling source is a cold ground water supply.

44. The refrigeration network of claim 43 in which the cold ground water supply has a closed system ground loop.

45. The refrigeration network of claim 38, in which the coolant source for providing coolant to said unit heat exchange circuits is an air-cooled heat exchanger as part of a dedicated normal temperature refrigeration system.

46. The refrigeration network of claim 38, in which said first, second and other refrigerated product zones are located within the shopping arena of the supermarket at spaced locations therein, and the dedicated first, second and other modular condensing unit racks are closely associated with the respective product zones adjacent to their respective locations.

47. The refrigeration network of claim 38, in which said first refrigerated product zone comprises frozen product merchandiser means having a plurality of low temperature first evaporator means therefor, and said second refrigerated product zone comprises non-frozen product merchandiser means having a plurality of medium temperature second evaporator means therefor.

48. The refrigeration network of claim 47, in which the frozen product merchandiser means and the non-frozen product merchandiser means are located within the shopping arena of the supermarket at spaced locations therein, and the dedicated first and second modular condensing unit racks are positioned immediately adjacent to the respective frozen and non-frozen product merchandiser means.

49. The refrigeration network of claim 38, in which the refrigerated product zones comprise a plurality of merchandisers located in the shopping arena of the supermarket; including first merchandisers incorporating said first evaporator means and associated first refrigerant control means and first refrigeration sensing means;

second merchandisers incorporating said second evaporator means and associated second refrigerant control means and second refrigeration sensing means; and other merchandisers incorporating said other evaporator means and associated other refrigerant control means and other refrigeration sensing means.

50. The refrigeration network of claim 49, in which each condensing unit rack is constructed and arranged to support the components of the corresponding refrigeration system unit except for said evaporator means and associated refrigerant control means and refrigeration sensing means.

51. The refrigeration network of claim 50, in which at least one of said refrigeration system units further includes heat recovery means constructed and arranged for environmental temperature control in the shopping arena.

52. The refrigeration network of claim 38, in which each first, second and other condensing unit rack is configured to accommodate two to ten separate compressors at predetermined rack positions, and said other components have predetermined rack positions relative to said compressors.

53. The refrigeration network of claim 52, in which said compressors are sized in the range of a fractional horsepower up to about ten horsepower, and are constructed and arranged to provide a variable refrigeration capacity balanced to the refrigeration loads imposed by the corresponding product zone.

54. The refrigeration network of claim 38, in which the compressor means of at least one of said first, second and other unit racks are scroll compressors constructed and arranged to operate at low noise and vibration levels.

55. The refrigeration network of claim 52, in which one of said first, second and other condensing unit rack configurations accommodates the placement of said compressors in horizontally disposed relationship.

56. The refrigeration network of claim 52, in which one of said first, second and other condensing unit rack configurations accommodates the placement of said compressors in a vertically disposed relationship.

57. The refrigeration network of claim 52, in which one of said first, second and other condensing unit rack configurations accommodates the placement of said compressors in a combination of horizontally and vertically disposed relationships.

58. The refrigeration network of claim 38 wherein the closed refrigeration circuit components of at least one of said first, second and other modular units further includes a control panel mounted on the condensing unit rack and being constructed and arranged for independently controlling refrigeration and defrosting function modes of said closed refrigeration circuit.

59. The refrigeration network of claim 58, in which the defrosting function mode of the closed refrigeration circuit is selected from a class of evaporator defrosting arrangements consisting of electric, hot gas, latent gas, reverse cycle, off time and ambient air defrost.

60. The refrigeration network of claim 59 wherein the closed refrigeration circuit components further include receiver means mounted on the condensing unit rack of said one modular unit and receiving condensate outflow from the condenser means for accumulating a supply source of liquid refrigerant for the associated system evaporator means, and said receiver means also forms a source of refrigerant vapor at saturation temperature for use in latent gas defrosting of said evaporator means.

61. The refrigeration network of claim 52 wherein the condensing unit racks for said first, second and other modular units each comprise a main frame and support platform means thereon, the main frame and said support platform means being preformed to accommodate selective placement of a variable number of the compressor means for each modular unit in predetermined horizontal, vertical and combination configurations on said support platform means.

62. The refrigeration network of claim 61 wherein the support platform means of each condensing unit rack comprises at least two support platform panels mounted on the main frame to accommodate said compressors and other component placement in vertically disposed relationships, and refrigerant conduit means of preformed configuration constructed and arranged to extend between and connect together the respective compressors, condenser means and other rack mounted components of each modular unit.

63. The refrigeration network of claim 38, and further comprising sound absorbing closure means for enclosing a least one side of the condensing unit rack of each modular unit, said sound absorbing closure means being constructed and arranged for inhibiting transmission of noise generated by closed refrigeration circuit components at the condensing unit racks to locations exterior of said sound absorbing closure means.

64. The refrigeration network of claim 63 in which the closed refrigeration circuit of each modular unit includes a control panel for controlling the refrigeration functions thereof, and at least one of said sound absorbing closure means being constructed and arranged for accessing the control panel of one modular unit.

65. The refrigeration network of claim 63 wherein said sound absorbing closure means comprises at least one insulating panel movable between an open position in which the condensing unit rack of one modular unit is exposed for access to closed refrigeration circuit components thereon and a closed position in which the one side of the condensing unit rack is covered by the one insulating panel.

66. The refrigeration network of claim 38 further comprising remotely activated contactor/circuit breaker means associated with each modular refrigeration system unit for providing distributed electrical power to electrical components of the refrigeration system unit.

67. A supermarket refrigeration network comprising:

a first modular refrigeration system unit in close strategic proximity to a first refrigerated product zone, and including a first condensing unit rack comprising first closed refrigeration circuit components including plural multiplexed compressor means, high side receiver means and associated high side and low side refrigerant delivery and suction means operatively connected to first evaporator means for cooling said first refrigerated zone, and said first refrigeration unit also including first condenser means connected between the compressor means and receiver means of said first closed refrigeration circuit;

at least one other modular refrigeration system unit in close strategic proximity to an associated other refrigerated product zone, and including an other condensing unit rack comprising other closed refrigeration circuit components including plural multiplexed compressor means, high side receiver means and associated high side and low side refrigerant delivery and suction means operatively connected to other evaporator means for cooling the other refrigerated zone, and said other refrigeration unit including other condenser means connected between the compressor means and receiver means of the other closed refrigeration circuit; and a coolant circulating system having a plurality of heat exchanger circuits in heat exchange relationship with the respective first and other condensing means for the respective first and other refrigeration system units, said coolant circulating system having at least one continuous cooling source for the coolant in said circulating system.

68. The refrigeration network of claim 67, in which the cooling source for providing coolant to said unit heat exchange circuits is selected from a class consisting of a cooling tower, a cold ground water supply, a dedicated normal temperature refrigeration system, a coolant chiller system, a commercial recirculating water supply, and an air-cooled heat exchanger.

69. The refrigeration network of claim 67, in which the coolant circulated to said unit heat exchange circuits is selected from a class consisting of a glycol solution and a chemically treated water solution.

70. The refrigeration network of claim 67, in which said first and other refrigerated product zones are located within the shopping arena of the supermarket at spaced locations therein, and the dedicated first and other condensing unit racks are closely associated with the respective product zones adjacent to their respective locations.

71. The refrigeration network of claim 67, in which said first refrigerated product zone comprises frozen product merchandiser means having a plurality of low temperature first evaporator means therefor, and said other refrigerated product zone comprises non-frozen product merchandiser means having a plurality of medium temperature other evaporator means therefor, the frozen product merchandiser means and the non-frozen product merchandiser means being located within the shopping arena of the supermarket at spaced locations therein, and the dedicated first and other condensing unit racks being positioned immediately adjacent to the respective frozen and non-frozen product merchandiser means.

72. The refrigeration network of claim 67, in which the refrigerated product zones comprise a plurality of merchandisers located in the shopping arena of the supermarket; including first merchandisers incorporating said first evaporator means and associated first refrigerant control means and first refrigeration sensing means; and other merchandisers incorporating said other evaporator means and associated other refrigerant control means and refrigeration sensing means.

73. The refrigeration network of claim 67, in which each of said first and other condensing unit racks is configured to accommodate two to ten separate compressors at predetermined rack positions, and said other components have predetermined rack positions relative to said compressors.

74. The refrigeration network of claim 73, in which said compressors are sized in the range of a fractional horsepower up to about ten horsepower, and are constructed and arranged to provide a variable refrigeration capacity balanced to the refrigeration loads imposed by the corresponding product zone.

75. The refrigeration network of claim 73 wherein the condensing unit racks for said first and other modular units each comprise a main frame and support platform means thereon, the main frame and said support platform means being preformed to accommodate selective placement of a variable number of the compressor means for each modular unit in predetermined horizontal, vertical and combination configurations on said support platform means.

76. The refrigeration network of claim 67, in which the compressor means of at least one of said first and other unit racks are scroll compressors constructed and arranged to operate at low noise and vibration levels.

77. The refrigeration network of claim 67 wherein the closed refrigeration circuit components of at least one of said first and other modular units further includes a control panel mounted on the condensing unit rack and being constructed and arranged for independently controlling refrigeration and defrosting function modes of said closed refrigeration circuit.

78. The refrigeration network of claim 67, and further comprising sound absorbing closure means for enclosing at least one side of the condensing unit rack of each modular unit, said sound absorbing closure means being constructed and arranged for inhibiting transmission of noise generated by closed refrigeration circuit components at the condensing unit racks to locations exterior of said sound absorbing closure means.

79. The refrigeration network of claim 78 wherein said sound absorbing closure means comprises at least one insulating panel movable between an open position in which the condensing unit rack of one modular unit is exposed for access to closed refrigeration circuit components thereon and a closed position in which the one side of the condensing unit rack is covered by the one insulating panel.

80. In combination, a modular commercial refrigeration unit constructed and arranged for placement in strategic proximity to a plurality of associated product cooling zones within the shopping arena of a food store, said refrigeration unit comprising a condensing unit rack configured to accommodate the maximum aggregate refrigeration loads of the associated cooling zones and having an optimum floor space footprint in the shopping arena, said condensing unit rack comprising refrigeration circuit components including a plurality of multiplexed compressor means, high side receiver means and associated high side and low side refrigerant delivery and suction means operatively connected to plural evaporator means for cooling the associated cooling zones, and said refrigeration unit also including condenser means connected between the compressor means and receiver means of the refrigeration circuit; and another cooling source remote from said condensing unit rack and operatively constructed and arranged to provide a heat exchange relationship with said condenser means for providing optimum condensing and cooling efficiency of said evaporator means in the associated zones.

81. The modular refrigeration unit of claim 80, in which said condensing unit rack is configured to accommodate two to ten separate compressors at predetermined rack positions, and said other components have predetermined rack positions relative to said compressors.

82. The modular refrigeration unit of claim 81, in which said compressors are sized in the range of a fractional horsepower up to about ten horsepower, and are constructed and arranged to provide a variable refrigeration capacity balanced to the refrigeration loads imposed by the associated product zone.

83. The modular refrigeration unit of claim 82, in which said compressors are of a rotary type constructed and arranged to operate at low noise and vibration levels.

84. The modular refrigeration unit of claim 83, in which said compressors are scroll compressors.

85. The refrigeration unit of claim 81 wherein said condensing unit rack comprises a main frame and support platform means thereon, the main frame and said support platform means being preformed to accommodate selective placement of a variable number of the compressors in predetermined horizontal, vertical and combination configurations on said support platform means.

86. The refrigeration unit of claim 80, in which at least one of said associated zones comprises a refrigerated merchandiser incorporating said evaporator means and additionally incorporates refrigerant control means and refrigeration sensing means associated with said evaporator means, and wherein the condensing unit rack is constructed and arranged to mount the closed refrigeration circuit components except for said evaporator means and its associated refrigerant control and sensing means.

87. The refrigeration unit of claim 80, in which said condenser means is incorporated into a heat exchanger in coolant flow relationship with the remote cooling source, and said heat exchanger and condenser means being mounted on the condensing unit rack.

88. The refrigeration unit of claim 87, in which coolant is delivered from the cooling source to the heat exchanger in a cool coolant delivery mode and heated by the heat of rejection from said condenser means to be carried away from the heat exchanger in a heated coolant return mode.

89. The refrigeration unit of claim 80 wherein the receiver means is mounted on said condensing unit rack and receives condensate outflow from said condenser means for accumulating a supply source of liquid refrigerant for the evaporator means.

90. The refrigeration unit of claim 89 wherein said receiver means also forms a source of refrigerant vapor at saturation temperature for use in latent gas defrosting of said evaporator means.

91. The refrigeration unit of claim 80 wherein the closed refrigeration circuit components further include a control panel mounted on said condensing unit rack and being constructed and arranged for independently controlling refrigeration and defrosting function modes of said refrigeration circuit.

92. The refrigeration unit of claim 91, in which the defrosting function mode of the refrigeration circuit is selected from a class of evaporator defrosting arrangements consisting of electric, hot gas, latent gas, reverse cycle, off time and ambient air defrost.

93. The refrigeration unit of claim 80, and further comprising sound absorbing closure means for enclosing at least one side of the condensing unit rack, said sound absorbing closure means being constructed and arranged for inhibiting transmission of noise generated by closed refrigeration circuit components at the condensing unit rack into the adjacent area of the shopping arena.

94. The refrigeration unit of claim 93 wherein said sound absorbing closure means comprises at least one insulating panel movable between an open position in which the condensing unit rack is exposed for access to closed refrigeration circuit components thereon and a closed position in which the one side of the condensing unit rack is covered by the one insulating panel.

95. The refrigeration unit of claim 94 wherein at least said one insulating panel is exposed to the shopping arena and is formed with an externally decorative appearance visible from the shopping arena.

96. The refrigeration unit of claim 93 wherein said sound absorbing closure means is associated with shelving means for storing and displaying non-refrigerated products in said shopping arena.

97. The refrigeration unit of claim 93 wherein said compressor means includes reciprocating compressors on said condensing unit rack, and said sound absorbing closure means comprises a plurality of insulating panels having sound absorbing material, the panels being constructed and arranged for enclosing the condensing unit rack to inhibit transmission of noise from the closed refrigeration circuit components mounted thereon into the shopping arena, and at least one of the insulating panels being movable from said rack enclosing position to an open position for accessing the condensing unit rack and the refrigeration circuit components thereon.

98. The refrigeration unit of claim 80, in which the cooling source for providing coolant heat exchange relationship with said condenser means is selected from a class consisting of a cooling tower, a cold ground water supply, a dedicated normal temperature refrigeration system, a coolant refrigeration chiller system, a commercial recirculating water supply, and an air-cooled heat exchanger.

99. The refrigeration unit of claim 80, in which the coolant source is located outside the shopping arena of the supermarket.

100. The refrigeration system of claim 37, in which said condenser means is incorporated into a heat exchanger on said condensing unit rack and in coolant flow relationship with the closed liquid loop.

101. The modular refrigeration system of claim 37, which include condensing unit rack at said second location and being configured to accommodate two to ten separate compressors at predetermined rack positions.

102. The modular refrigeration system of claim 101, in which said compressors are sized in the range of a fractional horsepower up to about ten horsepower, and are constructed and arranged to provide a variable refrigeration capacity balanced to the refrigeration loads imposed by the first stage evaporator coils.

103. The refrigeration system of claim 101 wherein the first stage closed loop refrigeration circuit includes a control panel mounted on said condensing unit rack and being constructed and arranged for independently controlling refrigeration and defrosting function modes of said refrigeration circuit.

104. The refrigeration system of claim 101, and further comprising sound absorbing closure means for enclosing at least one side of the condensing unit rack, said sound absorbing closure means being constructed and arranged for inhibiting transmission of noise generated by the compressors and other refrigeration circuit components at the condensing unit rack into the adjacent area of the store.

105. The refrigeration system of claim 104, wherein said sound absorbing closure means comprises at least one insulating panel movable between an open position in which the condensing unit rack is exposed for access to closed refrigeration circuit components thereon and a closed position in which the one side of the condensing unit rack is covered by the one insulating panel.

106. The refrigeration system of claim 101 wherein said condensing unit rack comprises a main frame and support platform means thereon, the main frame and said support platform means being preformed to accommodate selective placement of a variable number of the compressors in predetermined horizontal, vertical and combination configurations on said support platform means.

107. The refrigeration system of claim 106 wherein the support platform means comprises at least two support platform panels mounted on the main frame at vertically spaced levels and accommodating said compressors in vertically disposed relationships.

* * * * *

UNITED STATES PATENT AND TRADEMARK OFFICE

CERTIFICATE OF CORRECTION

PATENT NO. : 5,440,894

DATED : August 15, 1995

INVENTOR(S) : Wayne G. Schaeffer, William C. Wehmeier, Terry J. Broccard and John A. Behr

It is certified that error appears in the above-identified patent and that said Letters Patent is hereby corrected as shown below:

Column 1, line 19, after "condensing" add --units,--.
Column 7, line 8, "33H" should be --10H--.
Column 8, line 13, "expell" should be --expel--.
Column 9, line 28, "refrigerations" should be --refrigeration--.
Column 10, line 50, delete the comma; line 60, "it" should be --It--.
Column 11, line 36, "in" should be --In--.
Column 14, line 2 (claim 12), "zone" should be --zones--;

Column 23, line 26 (claim 101), "include" should be --includes a--.

Signed and Sealed this

Twenty-eighth Day of November 1995

*Attest:*

Bruce Lehman

BRUCE LEHMAN

*Attesting Officer*

*Commissioner of Patents and Trademarks*